US009709358B2

(12) United States Patent
Kincel

(10) Patent No.: US 9,709,358 B2
(45) Date of Patent: Jul. 18, 2017

(54) COUPLING VARIOUS FIREARM ACCESSORIES TO A FIREARM

(71) Applicant: Bravo Company USA, Inc., Hartland, WI (US)

(72) Inventor: Eric Kincel, Las Vegas, NV (US)

(73) Assignee: Bravo Company USA, Inc., Las Vegas, NV (US)

( * ) Notice: Subject to any disclaimer, the term of this patent is extended or adjusted under 35 U.S.C. 154(b) by 0 days.

(21) Appl. No.: 14/887,135

(22) Filed: Oct. 19, 2015

(65) Prior Publication Data

US 2016/0116252 A1 Apr. 28, 2016

Related U.S. Application Data

(60) Provisional application No. 62/067,367, filed on Oct. 22, 2014.

(51) Int. Cl.
*F41C 27/00* (2006.01)
*F41G 11/00* (2006.01)
*F41C 23/16* (2006.01)

(52) U.S. Cl.
CPC ..... *F41C 27/00* (2013.01); *F41C 23/16* (2013.01); *F41G 11/004* (2013.01)

(58) Field of Classification Search
CPC ..... F41C 23/16; F41C 27/00; F41C 33/0254; F41C 33/04; F41C 33/041; F41C 33/043; F41C 33/045; F41G 11/003; F41G 11/004; F41G 11/005; F41A 23/04; F41A 23/06; F41A 23/08; F41A 23/10; F41A 23/12; F41A 23/14; F41A 23/16
USPC ..... 42/85, 90, 111, 124, 125, 126, 127
See application file for complete search history.

(56) References Cited

U.S. PATENT DOCUMENTS 3,177,587 A * 4/1965 Hart ..... F41G 11/002 42/126
3,798,818 A * 3/1974 Casull ..... F41C 23/12 42/72
3,861,070 A * 1/1975 Wild ..... F41C 23/16 42/85
4,905,396 A * 3/1990 Bechtel ..... F41G 11/003 42/124
4,959,908 A * 10/1990 Weyrauch ..... F16B 3/00 42/124
7,430,829 B2 * 10/2008 Murello ..... F41G 11/007 42/124

(Continued)

*Primary Examiner* — Bret Hayes
(74) *Attorney, Agent, or Firm* — Lewis Roca Rothgerber Christie LLP

(57) ABSTRACT

A system for coupling various firearm accessories to a firearm may include an anchor that couples to a firearm accessory rail of the firearm and a coupling member that couples a firearm accessory to the anchor. A method of coupling various firearm accessories to a firearm may involve positioning an anchor within the body of a firearm accessory to be coupled to the firearm and bringing the anchor into contact with a firearm accessory rail of the firearm. The method may involve bringing the anchor into tension with the firearm accessory rail such that the anchor is securely engaged with the rail (e.g., through the use of a coupling member, integrated anchor shaft, and/or nut or other component). The systems and methods may couple a wide variety of firearm accessories to a wide variety of firearm accessory rails.

17 Claims, 30 Drawing Sheets

(56) References Cited

U.S. PATENT DOCUMENTS

| | | | | |
|---|---|---|---|---|
| 8,006,430 | B2 * | 8/2011 | Wang | F41G 11/003 42/125 |
| 2001/0045046 | A1 * | 11/2001 | Otteman | F41G 1/38 42/136 |
| 2004/0009034 | A1 * | 1/2004 | Miller | F41G 11/003 403/363 |
| 2009/0000175 | A1 * | 1/2009 | Potterfield | F41A 23/10 42/94 |
| 2011/0032694 | A1 * | 2/2011 | Swan | F41C 23/16 362/157 |
| 2012/0167434 | A1 * | 7/2012 | Masters | F41C 23/16 42/90 |
| 2013/0031820 | A1 * | 2/2013 | Deros | F41G 11/003 42/90 |
| 2014/0115940 | A1 * | 5/2014 | Bonelli | F16M 11/14 42/94 |
| 2015/0267993 | A1 * | 9/2015 | Cheng | F41C 27/00 42/90 |
| 2016/0025120 | A1 * | 1/2016 | Swan | F41G 11/003 248/231.31 |

* cited by examiner

10

COUPLING VARIOUS FIREARM ACCESSORIES TO A FIREARM

CROSS-REFERENCE TO RELATED APPLICATION

The present application claims the priority benefit of U.S. provisional application No. 62/067,367 filed Oct. 22, 2014 and entitled "Coupling Various Firearm Accessories to a Firearm," the disclosure of which is incorporated herein by reference.

BACKGROUND

Field of the Disclosure

The present disclosure concerns firearms. More particularly, the present disclosure concerns systems and methods for coupling various types of firearm accessories (e.g., sling mounts, bipods, vertical grips, handstops, sights, scopes, lasers, and other optical aiming devices) to a firearm.

Description of the Related Art

Firearm users have long desired ways to flexibly enhance the functionality of stock firearms. As a result, modern day firearms like the AR-15 and M-16 often feature an accessory rail capable of coupling to one or more accessories such as a vertical grip, handstop, flashlight, or sling mount, to name a few. In most firearm designs, the accessory rail is either coupled to or permanently integrated with the barrel, upper receiver, handguard, or forestock of the firearm. The most well-known accessory rail is the Military Standard 1913 Picatinny Arsenal rail, commonly referred to simply as a "Picatinny rail." Although the Picatinny rail is still commonly used today, firearm designers have also begun producing other types of rails, including modular external accessory rails. One such modular external accessory rail is the KeyMod™ rail designed by Eric Kincel and VLTOR Weapon Systems of Tucson, Ariz.

To date, firearm users have typically coupled firearm accessories to accessory rails by using a traditional "screw and nut" method. When using the traditional screw and nut method, a user may align threaded holes in the accessory with a corresponding hole, groove, slot, or other opening in the accessory rail. There are several ways in which the accessory may be installed before it is secured in place by the screw and nut. After having aligned the accessory with the rail, the user may place a screw in each threaded hole and tighten the screw until it compresses the accessory against the rail. The tension applied by the compressed screw and nut holds the accessory in place against the accessory rail. Some versions of the traditional screw and nut method use screws and conventional KeyMod™ nuts.

Other methods of coupling firearm accessories to accessory rails utilize slide-on mechanisms. In many cases, the top of the accessory contains a groove into which the bottom edge of a correspondingly shaped accessory rail slides. When using the slide-on method, a user may slide the accessory onto the rail. After doing so, the user may effectively "lock" the accessory in place to prevent further sliding along the rail. In many cases, the user may do so by tightening a "screw-core" locking mechanism that runs through the accessory. When tightened sufficiently, the screw-core protrudes from the accessory into a corresponding hole in the accessory rail. Having been fitted within the hole in the accessory rail, the protruding portion of the screw-core then impedes any further movement of the accessory along the rail.

A similar method relies on a rotatable accessory body. When using the rotatable body method, rather than sliding the accessory into a groove in the accessory rail, the user rotates the body of the accessory onto the edge of the rail before locking it into place using a screw-core mechanism. Another method features a thumb knob in place of the screw discussed above, while yet another requires the use of moveable clamps or throw-lever tensioning devices to hold the accessory in place against the accessory rail.

Although adequate in some scenarios, each of the above methods suffers from one or more limitations. Some are less than optimal because they require the use of coupling mechanisms that feature numerous moving parts (e.g., the screw and nut method). When coupling mechanisms feature numerous moving parts, they are more costly to manufacture and ultimately more expensive to purchase as a consumer. The use of many moving parts also increases the likelihood of mechanical failure. Other methods are sub-optimal because they rely on coupling devices that, after having been installed, protrude from the firearm and risk getting snagged on clothing, equipment, or other nearby objects. Other methods are limited in their usefulness simply because they are inconvenient and/or difficult for users to perform. Given such limitations, there is a need in the firearm community for improved systems and methods of coupling various types of firearm accessories to a firearm.

SUMMARY OF THE CLAIMED INVENTION

Systems and methods for coupling various types of firearm accessories to a firearm are claimed.

In a first claimed embodiment, a system for coupling a firearm accessory to a firearm includes an anchor that couples to a firearm accessory rail of the firearm. The anchor includes a slot. The system further includes a nut housed within the slot of the anchor and a coupling member. The coupling member couples the anchor to the firearm accessory rail when inserted into the nut through a bottom end of the firearm accessory and tightened until the anchor is pulled into tension with both the firearm accessory and the firearm accessory rail.

In a second claimed embodiment, a method of coupling a firearm accessory to a firearm includes inserting a nut into an anchor. The anchor is positioned within the body of the firearm accessory to be coupled to the firearm. The anchor is brought into contact with a firearm accessory rail coupled to the firearm. A coupling member is then inserted through a bottom end of the firearm accessory into the nut disposed in the anchor and tightened to the nut until the anchor is pulled into tension with both the firearm accessory and the firearm accessory rail.

DETAILED DESCRIPTION

Systems and methods for coupling various types of firearm accessories to a firearm are provided. Although certain embodiments of systems and methods are discussed in this disclosure, it should be understood that those particular embodiments are exemplary only and in no way limit the scope of the disclosure. The embodiments displayed and discussed in this disclosure were selected in an attempt to most clearly convey the inventive concepts. Persons of ordinary skill in the art will readily recognize and appreciate that the present disclosure suggests many other possible embodiments in addition to those expressly described herein.

For instance, although embodiments are described in the context of coupling exemplary accessories (e.g., a vertical grip, a handstop, etc.) to various types of firearm accessory rails (e.g., an external modular rail system with a keyhole configuration, a Picatinny rail, etc.), it should be readily apparent to persons of ordinary skill in the art that the systems and methods described herein are equally suitable for coupling other accessories, such as flashlights, supplemental rail panels, scopes, optical aiming devices (e.g., infrared/laser sights), bipods, or any number of other firearm accessories. It should also be readily apparent to persons of ordinary skill in the art that the methods and system described herein are equally applicable to other types of accessory rails aside from the exemplary external modular rail system and Picatinny rail depicted in the present disclosure. In other words, it is contemplated that the system and methods disclosed herein may be used to attach any firearm accessory to any type of accessory rail.

The systems and methods described herein provide a simple and robust yet low-cost solution for mounting various types of firearm accessories to a firearm. Certain embodiments may be manufactured cheaper and more efficiently than existing mounting systems and methods and, as a result, may retail to the consumer for less than half the price of those alternative systems and methods. Such embodiments feature fewer parts than alternative mounting systems and methods, which extends the life and quality of the both the system and the firearm accessory to which it is coupled. Having fewer parts also reduces the weight of the firearm, which ultimately reduces the overall weight of the user. In battle, the overall weight of a fighter is critical because less weight devoted to equipment means more capacity for carrying ammunition. In some cases, for example, a vertical grip featuring an embodiment of the system described herein may weigh as little as 1.9 ounces compared to weighing 2.6 ounces when coupled to a firearm using an alternative mounting system or method. Embodiments further provide increased pullout strength over the use of standard screw and nut methods (e.g., conventional KeyMod™ nuts).

Figure 1:
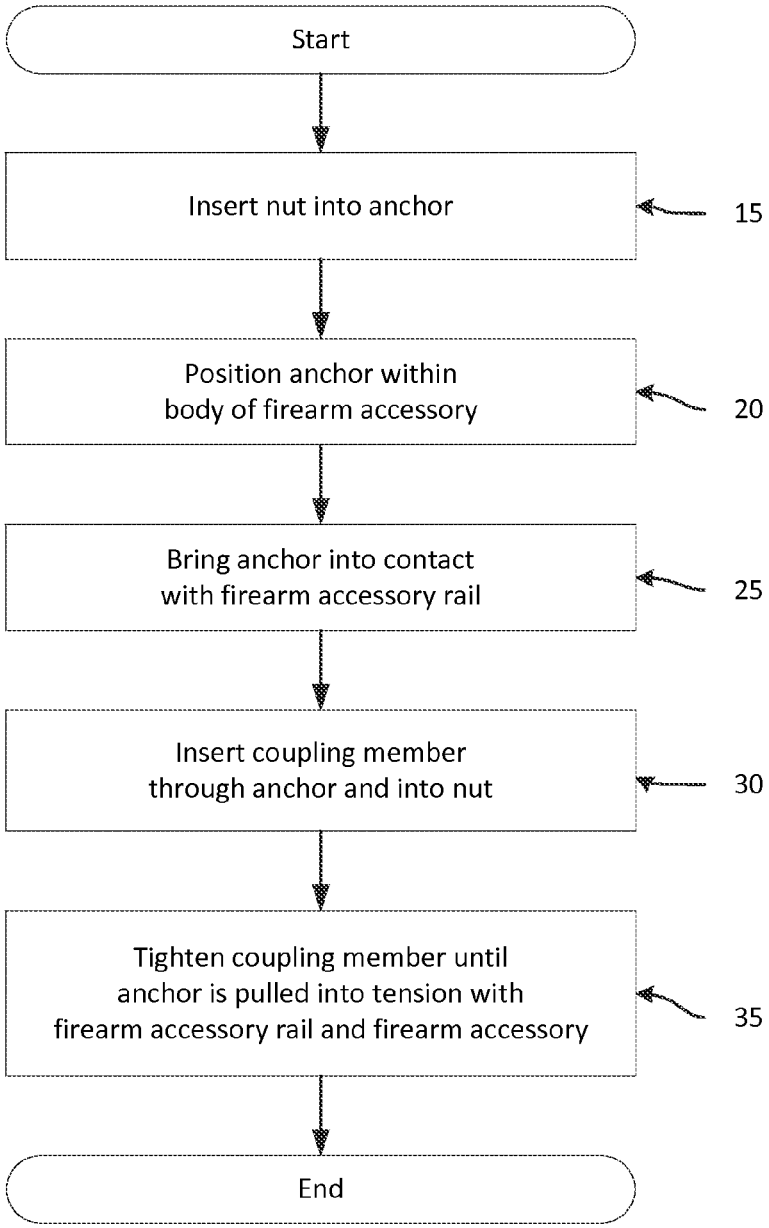
FIG. 1 is a flow diagram illustrating an exemplary method for coupling various types of firearm accessories to a firearm.

FIG. 1 is a flow diagram illustrating an exemplary method for coupling various types of firearm accessories to a firearm. In one embodiment, a method 10 of coupling a firearm accessory to a firearm may include inserting a nut into an anchor at step 15. Notably, in some embodiments, the method may omit a step of inserting a loose, individual nut into the anchor because the anchor itself may be threaded so as to effectively serve as an integrated nut. In various other embodiments, the anchor may house a bolt that accepts a threaded nut, or the anchor itself may include an integrated shaft that is threaded to mate with a nut. In such cases, the method may include tightening the nut as opposed to tightening the coupling member (as discussed below).

The method may further include, at step 20, positioning the anchor within the body of the firearm accessory that a user desires to couple to the firearm. The method may include bringing the anchor into contact with the firearm accessory rail at step 25. Depending on the type of anchor being used, which itself may depend on the type of firearm accessory rail being used, bringing the anchor into contact with the firearm accessory rail may include bringing particular surfaces of the components into contact with one another. In some embodiments, bringing particular surfaces of the components into contact with one another may require multiple steps, such as inserting and sliding (as might be required when the firearm accessory rail is a modular external rail system with a keyhole configuration, such as a KeyMod™ rail), or tilting the anchor (as might be required when the firearm accessory rail is a Picatinny rail or other rail that does not feature a keyhole configuration).

The method may further include, at step 30, inserting a coupling member through the anchor and into the nut that was previously inserted into the anchor. The coupling member may be inserted through a bottom end of the firearm accessory (e.g., the bottom end of a grip body in the case of a vertical grip accessory). The coupling member may then be passed through an intermediate wall of the firearm accessory before it reaches the anchor. The method may then include, at step 35, tightening the coupling member until the anchor is pulled into tension with the firearm accessory rail. Where the method also includes inserting the coupling member through an intermediate wall of the firearm accessory before it reaches the anchor, the coupling member, the intermediate wall of the firearm accessory, the anchor, and the firearm accessory rail may all be brought securely into tension with one another. As noted above, in some embodiments the anchor itself may effectively serve as the nut by directly receiving the coupling member (e.g., at a threaded void). Alternatively, the anchor may include a threaded bolt or shaft that accepts a threaded nut.

The foregoing method may be used to couple any number of accessories to a firearm, such as a flashlight, a scope, a laser sight, a grip, a supplemental Picatinny rail panel, or a supplemental modular external accessory rail panel with a keyhole configuration that mates with firearm accessories (e.g., a supplemental KeyMod™ rail panel). The foregoing method may be performed in a different order or with more or less steps than described above with respect to one illustrative embodiment. In some instances, for example, the method may include bringing the anchor, which along with the nut may have been preinstalled into the body of the firearm accessory, into contact with the firearm accessory rail as discussed with respect to step 25. The method may then include, as discussed with respect to step 30, inserting a coupling member through the anchor and into the nut installed in the anchor. The method may then include, as discussed with respect to step 35, tightening the coupling member until the anchor is pulled into tension with the firearm accessory rail.

Figure 2:
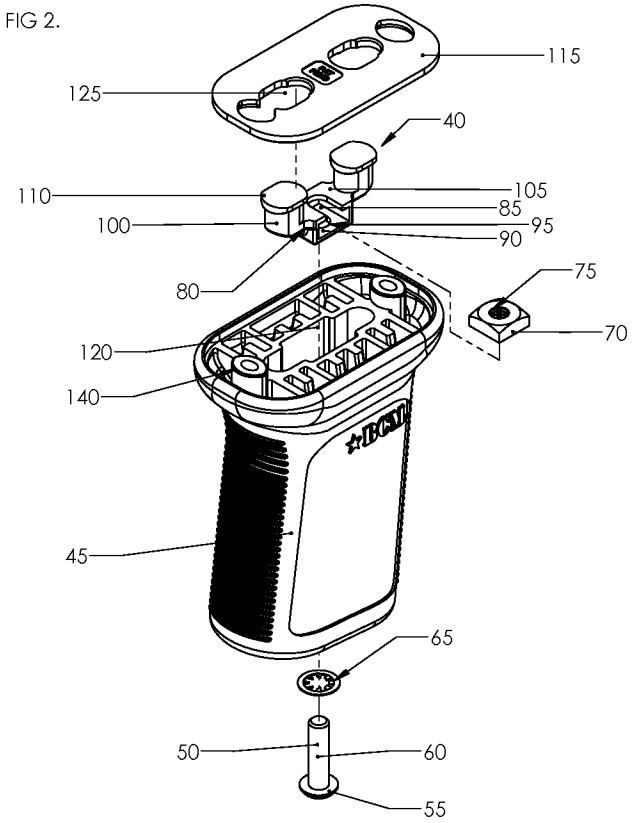
FIG. 2 is an exploded isometric view of an exemplary system for coupling various types of firearm accessories to a firearm.

FIG. 2 is an exploded isometric view of an exemplary system for coupling various types of firearm accessories to a firearm. In FIG. 2, exemplary system 40 is shown in connection with vertical grip 45 for illustrative purposes and to provide suitable context. It should be understood that vertical grip 45 is merely an exemplary firearm accessory and that any number of other accessories could have been selected to provide context.

System 40 may include a coupling member 50. Coupling member 50 may be a screw, bolt, or other suitable fastener, and may include a head 55 attached to a body 60. Body 60 may be threaded in some embodiments. Head 55 may include a drive region into which a screwdriver or other tool may be inserted and used to drive coupling member 50. In some embodiments, system 40 may include a washer 65 through which body 60 of coupling member 50 may pass. System 40 may include a nut 70, which in some embodiments (like that shown in FIG. 2), may be square in shape. Nut 70 may include a void 75 sized to mate with body 60 of coupling member 50. Where body 60 of coupling member is threaded, so too may the void in nut 70 be correspondingly threaded to facilitate an appropriate mating between the two components.

System 40 may include an anchor 80. Anchor 80 may take a variety of shapes (e.g., Y-shaped as shown in FIG. 2 or U-shaped). In one embodiment, as shown in FIG. 2, anchor 80 may include a slot 85 into which nut 70 may be seated. Where nut 70 is square, slot 85 may likewise be square to ensure that nut 70 is tightly seated. In such cases, square nut 70 may eliminate the need for threads in anchor 80. Alternatively, rather than utilizing slot 85 and correspondingly shaped square nut 70, anchor 80 may include a tapped or threaded hole. Slot 85 may be partially formed by a bottom surface 90 of anchor 80. Bottom surface 90 may include a void 95 sized to mate with body 60 of coupling member 50. Void 95 may be a singular round thru-hole, a tapped hole, a threaded hole, or a U-shaped slot. When nut 70 is properly seated within slot 80, void 95 of bottom surface 90 may align with void 75 of nut 70 such that coupling member 50, when driven or tightened, may engage nut 70 and pull nut 70 toward coupling member 50, which itself may be seated against a wall of vertical grip 45, such as an interior or outer wall (as shown later in FIG. 5).

When coupling member 50 is seated within vertical grip 45 such that body 60 of coupling member 50 may pass through a void in an internal wall of vertical grip 45 but head 55 of coupling member 50 may not pass through the void in the internal wall, driving or tightening coupling member 50 effectively pulls nut 70 toward coupling member 50. Because nut 70 is securely seated within slot 85 of anchor 80, anchor 80 is likewise pulled toward coupling member 45. Coupling member 45 may be driven or tightened until nut 70 and, by extension, anchor 80 are securely engaged against an interior wall of vertical grip 45. In some embodiments, coupling member 45 may be driven or tightened until head 55 is tensioned against an outer surface of firearm accessory 45, rather than an interior wall.

In various embodiments, system 40 may not require nut 70. For instance, in some embodiments anchor 80 may itself serve as nut 70 by directly mating with coupling member 45 at, for example, a threaded void. Alternatively, anchor 80 may include a threaded bolt or shaft that accepts a threaded nut. Persons of ordinary skill in the art will readily recognize and appreciate that other possible configurations may be suitable depending on various design considerations concerning system 40.

Anchor 80 may further include a plurality of arms or posts 100. As illustrated in FIG. 2, anchor 80 may be a solid, single-cast component that includes both slot 85, bottom surface 90, void 95, arms 100, and an upper surface 105 from which arms 100 extend. Anchor 80 may be molded or otherwise created as a solid, single-cast component, or it may be created by attaching or coupling sub-components together. Arms 100 may extend from a slotted box containing slot 85, bottom surface 90, void 95, and an upper surface 105. Arms 100 may each include, at a distal end, an elongated surface 110 oriented perpendicular to the length of arm 100 and parallel to upper surface 105. Elongated surface 110 may be "elongated" in the sense that it has a surface area greater than the cross-sectional area of arm 100 and therefore forms a ridge, rim, or lip with respect to arm 100. Elongated surface 110 engages more surface area of firearm accessory rail 130 (e.g., a greater portion of the chamfered region disposed on the inside of each keyhole-shaped void in the case of a rail featuring keyhole configurations) than conventional nuts designed for use with rails featuring keyhole configurations.

In some embodiments, system 40 may further include a plug 115. Plug 115 may be any shape or size suitable to plug, cap, or otherwise cover any exposed region of the firearm accessory to which system 40 is coupled. For instance, as shown in FIG. 2, plug 275 is sized and shaped to cover an exposed region 120 in vertical grip 45. Plug 115 may contain one or more voids 125. Some of voids 125 may permit arms 100 (including elongated surfaces 110) to pass through plug 115 and protrude outwardly therefrom. Other voids 125 may be sized to permit one or more recoil lugs 140 to pass through plug 115 and protrude therefrom. Plug 115 may prevent debris from entering the interior of the firearm accessory.

Figure 3:
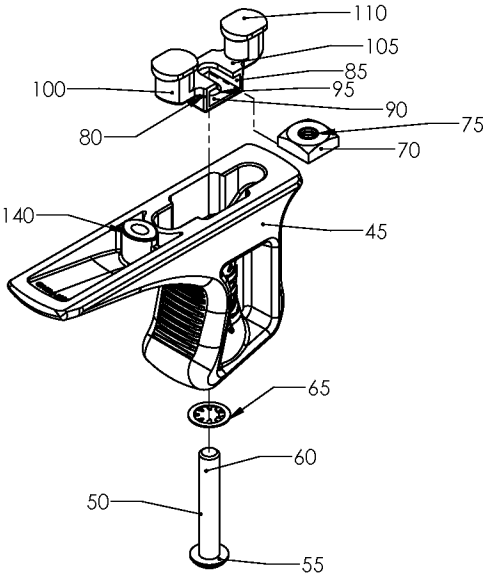
FIG. 3 is another exploded isometric view of an exemplary system for coupling various types of firearm accessories to a firearm.

FIG. 3 is another exploded isometric view of an exemplary system for coupling various types of firearm accessories to a firearm. FIG. 3 is similar to FIG. 2 as described above, except that in FIG. 3 the exemplary firearm accessory 45 being coupled to a firearm using an embodiment of the systems and methods disclosed herein is a handstop rather than a vertical grip. Unlike the embodiment shown in FIG. 2, the embodiment shown in FIG. 3 does not include plug 115. Whether or not optional plug 115 is present in a given embodiment will depend on the nature of the firearm accessory being coupled to the firearm.

Figure 4C:
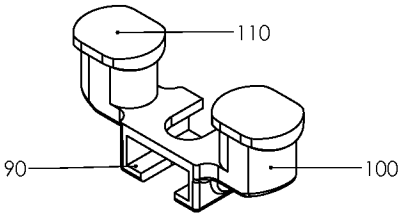
FIGS. 4A-4C are, respectively, top, front, and isometric views of an exemplary anchor.
Figure 4A:
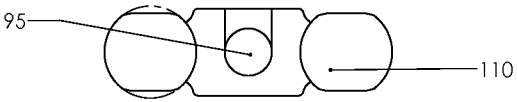
Figure 4B:
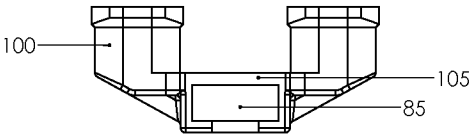

FIGS. 4A-4C are, respectively, top, front, and isometric views of an exemplary anchor like that depicted and described in the context of FIGS. 2 and 3. The various views of anchor 80 show slot 85, bottom surface 90, void 95, arms 100, upper surface 105, and elongated surfaces 110. As discussed above, anchor 80 provides greater pullout strength over conventional nuts used with rails featuring keyhole configurations. Unlike systems relying on conventional nuts, anchor 80 may be tightened to the accessory rail through the use of only a single coupling member (thus facilitating the ease and speed of using the technology described herein).

Figure 5:
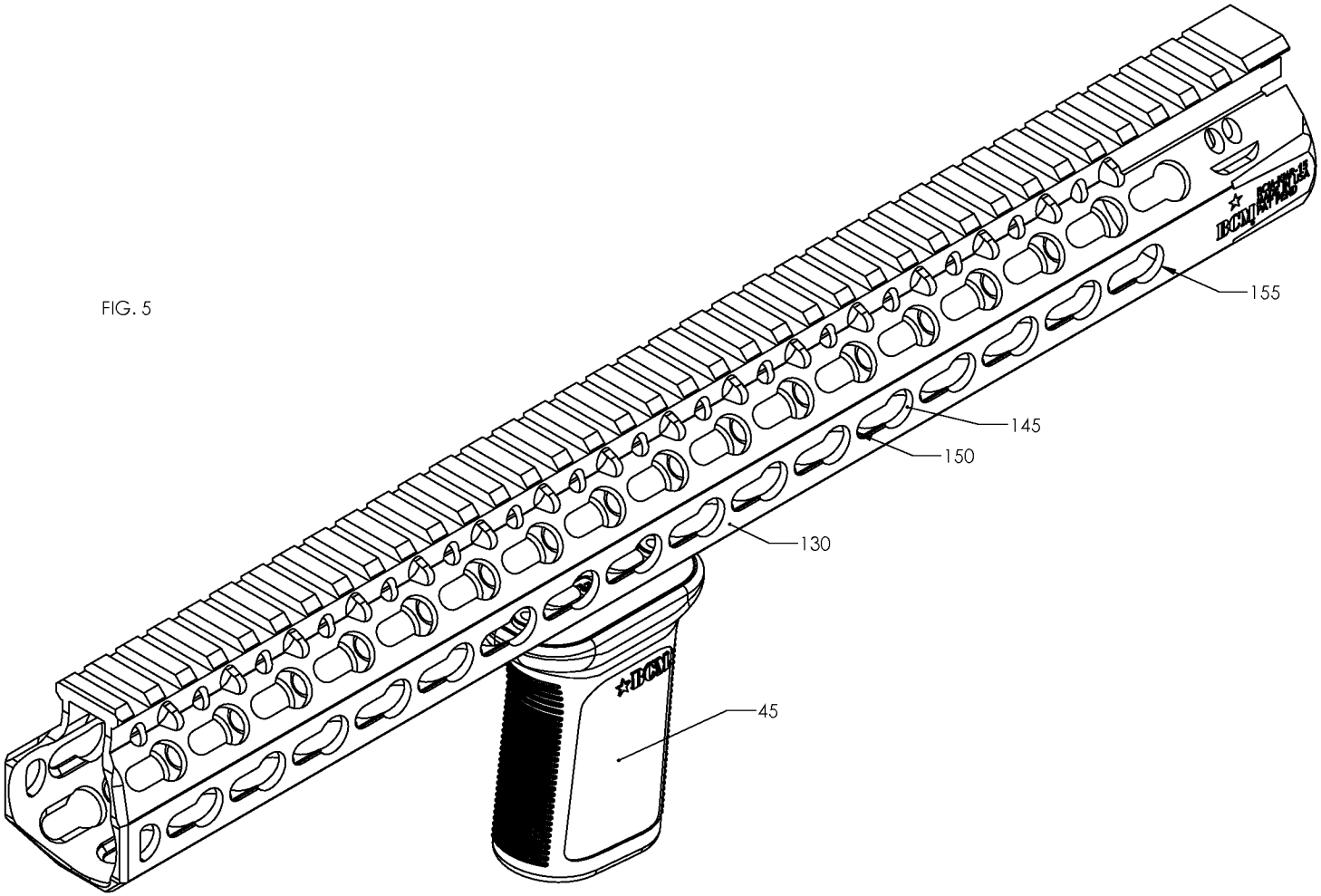
FIGS. 5 and 6 are, respectively, an isometric and side view of a vertical grip coupled to an external modular rail system by an exemplary system for coupling various types of firearm accessories to a firearm
Figure 6:
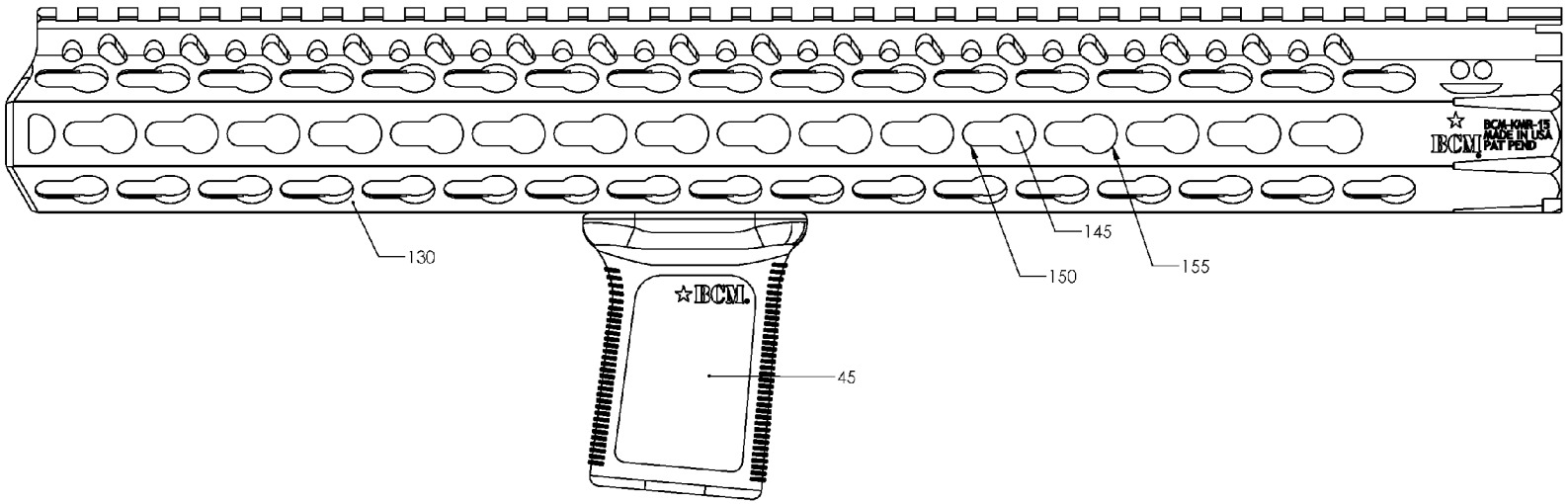

FIGS. 5 and 6 are, respectively, an isometric and side view of a vertical grip coupled to an external modular rail system by an exemplary system for coupling various types of firearm accessories to a firearm. As shown in FIG. 5, in one embodiment, system 40 may couple a firearm accessory such as vertical grip 45 to a firearm accessory rail 130. In the illustrative embodiment shown in FIG. 5, firearm accessory rail 130 is an external modular rail system that features a keyhole configuration. One example of such a rail system is a KeyMod™ rail. As illustrated later, any type of rail system may be used in connection with embodiments of system 40, including a standard Picatinny rail. It should be understood that, in practice, firearm accessory rail 130 itself is coupled to the firearm that the firearm accessory at issue is designed to enhance. To clearly illustrate the inventive concepts disclosed herein without unnecessarily diluting the focus of the present disclosure, only the accessory rail is shown.

Figure 7:
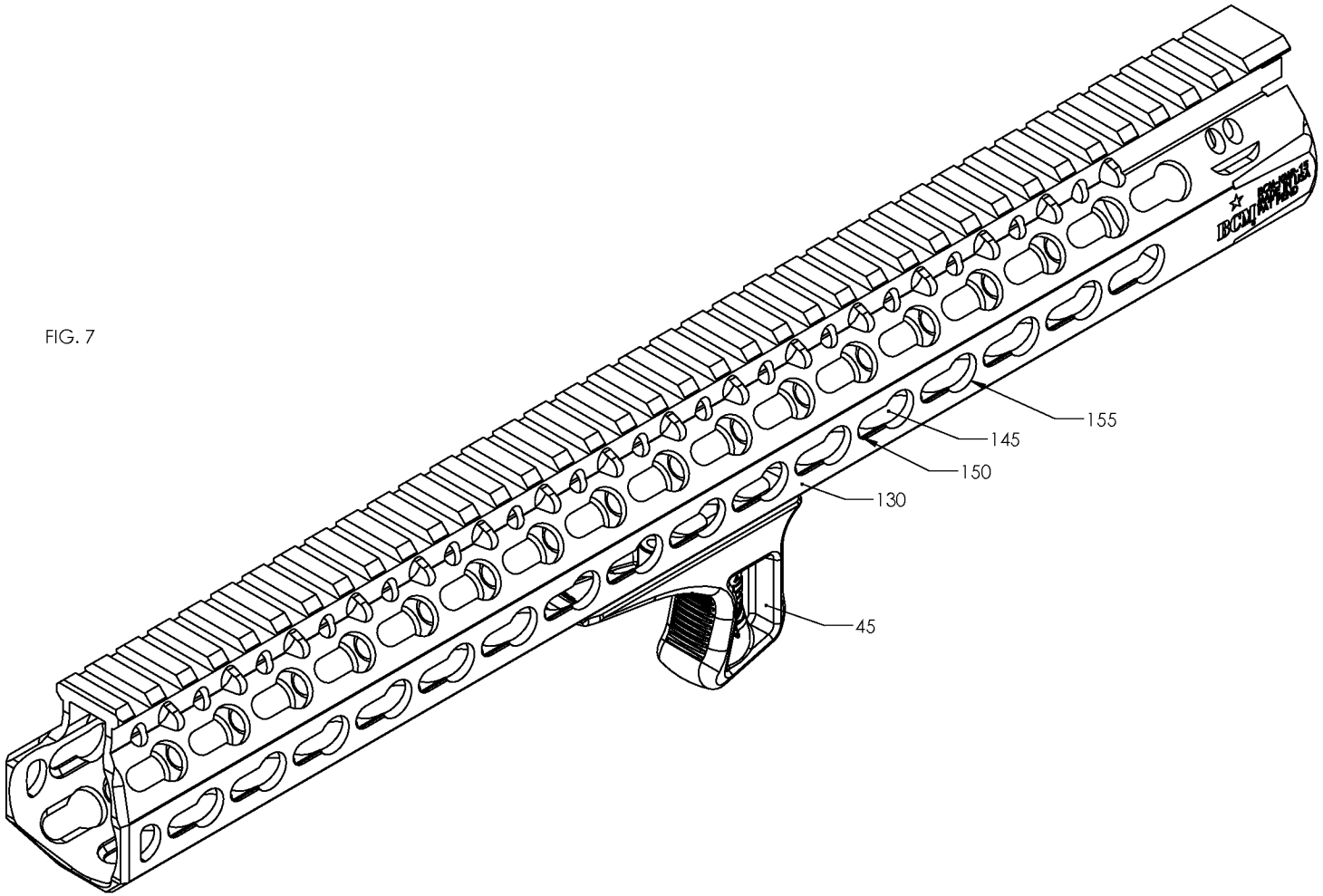
FIGS. 7 and 8 are, respectively, an isometric and side view of a handstop coupled to an external modular rail system by an exemplary system for coupling various types of firearm accessories to a firearm.
Figure 8:
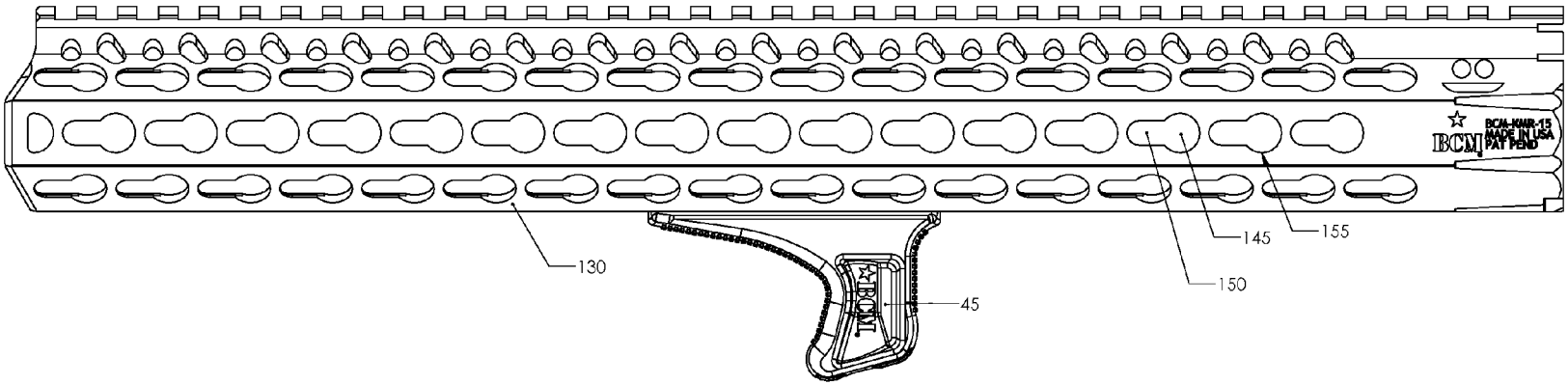

FIGS. 7 and 8 are, respectively, an isometric and side view of a handstop coupled to an external modular rail system by an exemplary system for coupling various types of firearm accessories to a firearm. FIGS. 7 and 8 are similar to FIGS. 5 and 6 as described above, except that in FIGS. 7 and 8 the exemplary firearm accessory 45 being coupled to a firearm using an embodiment of the systems and methods disclosed herein is a handstop rather than a vertical grip.

Figure 9:
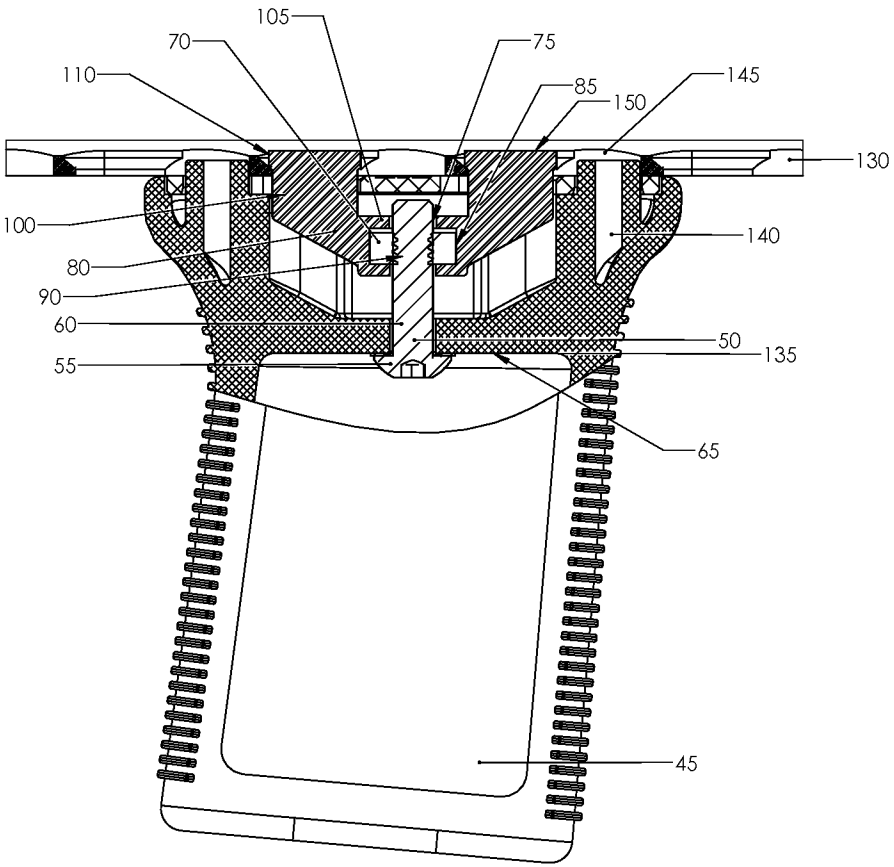
FIG. 9 is a cross-sectional side view of a vertical grip coupled to an external modular rail system by an exemplary system for coupling various types of firearm accessories to a firearm.

FIG. 9 is a cross-sectional side view of a vertical grip coupled to an external modular rail system by an exemplary system for coupling various types of firearm accessories to a firearm. In one embodiment, system 40 may couple a firearm accessory such as vertical grip 45 to firearm accessory rail 130. As previously noted, vertical grip 45 is depicted for illustrative purposes and is merely an exemplary firearm accessory with which system 40 may be used. System 40 may couple any number of firearm accessories to firearm accessory rail 130, such as handstops, flashlights, scopes, supplemental rail panels, optical aiming devices (e.g., infrared/laser sights), bipods, or any other desired accessories.

As depicted in the exemplary scenario of FIG. 9, coupling member 50 is a threaded screw and includes head 55 attached to threaded body 60. Head 55 includes a drive region used to tighten coupling member 50. System 40 includes a washer 65 through which body 60 of coupling member 50 passes. System 40 also includes square nut 70, which itself includes void 75 sized to mate with body 60 of coupling member 50. Void 75 in nut 70 is correspondingly threaded to facilitate an appropriate mating between nut 70 and coupling member 50.

System 40 includes anchor 80. Anchor 80 includes slot 85 into which nut 70 is seated. Because slot 85 is square like nut 70, nut 70 is tightly seated. Slot 85 is partially formed by bottom surface 90 of anchor 80. Bottom surface 90 includes void 95 sized to mate with body 60 of coupling member 50. Void 95 of bottom surface 90 is aligned with void 75 of nut 70 and coupling member 50 has engaged nut 70 and pulled nut 70 toward coupling member 50. Coupling member 50 is abuttedly engaged with an interior wall 135 of vertical grip 45. As shown in FIG. 9, because coupling member 50 was abuttedly engaged with vertical grip 45 such that body 60 of coupling member 50 could pass through a void in internal wall 135 of vertical grip 45 but head 55 of coupling member 50 could not, coupling member 50, when tightened, effectively pulled nut 70 toward coupling member 50. Because nut 70 is securely seated within slot 85 of anchor 80, anchor 80 was likewise pulled toward coupling member 45. Coupling member 45 was then tightened until nut 70 and, by extension, anchor 80 became securely engaged against an opposite side of interior wall 135 (or any other suitable surface) within vertical grip 45.

In embodiments that do not include nut 70, such as those in which anchor 80 itself serves as nut 70 by directly mating with coupling member 45 or those in which anchor 80 includes a bolt or shaft that accepts a threaded nut, coupling member 45 and anchor 80 may be tightened until the same are securely engaged as described above or in any other suitable manner readily appreciable by persons of ordinary skill in the art.

Anchor 80 includes two arms 100. As shown in FIG. 9, anchor 80 is a solid, single component that includes both slot 85, bottom surface 90, void 95, arms 100, and upper surface 105 from which arms 100 extend. Arms 100 each include, at a distal end, elongated surface 110 oriented perpendicular to the length of arm 100. As previously discussed, elongated surface 110 is "elongated" in the sense that it forms a ridge, rim, or lip with respect to arm 100. System 40 also includes plug 115. Plug 115 is sized and shaped to cover exposed region 120 in vertical grip 45. Plug 115 contains a plurality of voids 125. Some of voids 125 permit arms 100 (including elongated surfaces 110) to pass through plug 115 and protrude outwardly therefrom. Other voids 125 are sized to permit recoil lugs 140 to pass through plug 100 and protrude therefrom. When anchor 80 is tightened to a firearm accessory rail, arms 100 are forced in a first direction against an inner surface of a void (e.g., a keyhole-shaped void) in the firearm accessory, while the recoil lugs 140 are forced in a second direction opposite the first direction against a different inner surface of a void in the firearm accessory. As a result, arms 100 and recoil lugs 140 function together to produce a cross-compression that eliminates any movement of the system that might otherwise occur from firearm recoil. The system may include a single recoil lug 140 or it may include multiple recoil lugs 140 so as to make the system reversible with respect to muzzle of the firearm to which the firearm accessory is coupled.

In the exemplary embodiment shown in FIG. 9, firearm accessory rail 130 is an external modular rail system with a keyhole configuration. One such rail with a keyhole configuration is a KeyMod™ rail. Any type of rail system may be used in connection with embodiments of system 40, including a standard Picatinny rail. Referring back to FIGS. 5 and 6, in which firearm accessory rail 130 is an external modular rail system with a keyhole configuration like firearm accessory rail 130 shown in FIG. 9, firearm accessory rail 130 may include a first region 145 and a second region 150, each of which may be defined by a distinctly sized hollow area. In some embodiments, first region 145 and second region 150 may be part of a common void 155. The area of second region 150 may be less than the area of first region 145. As a result, objects of a certain diameter may pass through first region 145 without being able to pass through second region 150. Second region 150 may include a camfered perimeter that centers each arm 100 and draws arm 100 toward the end of second region 150 furthest from first region 145 as the arm 100 is tightened against firearm accessory rail 130. In some embodiments, like that shown in FIGS. 5 and 6, firearm accessory rail 130 may include a plurality of voids 155.

Referring back to FIG. 9, first region 145 and second region 150 (which together form common void 155) are visible in the cross-sectional side view. In the example shown, the area of second region 150 is less than the area of first region 145 such that elongated surface 110 of each arm 100 of anchor 80 may pass through first region 145 but may not pass through second region 150. Only arm 100, which features a smaller diameter compared to the lip created by elongated surface 110, may pass through second region 150. As a result, in operation, elongated surface 110 of each arm 100 of anchor 80 may be inserted into a respective first region 145 and slid into second region 150. Once positioned in second region 150, elongated surface 110 of each arm 100 abuttedly engages firearm accessory rail 130 and prevents anchor 80 from being pulled away from firearm accessory rail 130. Elongated surface 110 engages more surface area of firearm accessory rail 130 than traditional nuts used with rails featuring keyhole configurations. As noted above, in the fully engaged configuration shown in FIG. 5, coupling member 45 has been then tightened until anchor 80 has become securely engaged with firearm accessory rail 130 by virtue of anchor 80 being pulled towards head 55 of coupling member 50 while at the same time having elongated surfaces 110 of arms 100 abuttedly engaged with the surface of firearm accessory rail 130 surrounding second region 150 of keyhole-shaped void 155.

In some embodiments, recoil lugs 140 may be oriented such that, when firearm accessory 45 is properly coupled to firearm accessory rail 130 using the method and systems disclosed herein, each recoil lug 140 may rest snugly against the inner edge of first region 145 of keyhole-shaped void 155 (effectively serving as the recoil hole). In some embodiments, recoil lug 140 may be slightly offset from the inner edge of void 155 such that the pressure resulting from tightening coupling member 50 and the resultant pull on anchor 80 makes recoil lug 140 snap into place against the inner edge. As coupling member 50 is loosened, recoil lug 140 may exit first region 145 of keyhole-shaped void 155 and permit firearm accessory 45 to be removed. When system 40 is fully engaged, recoil lug 140 may help to further "lock" firearm accessory 45 into place and stabilize firearm accessory 45 against natural component stress caused by firearm recoil. More particularly, recoil lug 140 may help to transfer some of the stress forces caused by firearm recoil away from coupling member 50. In that way, recoil lug 140 may help to prolong the life of coupling member 50.

Notably, FIGS. 5 through 9 depict firearm accessory rail 130 as an external modular rail system with a keyhole configuration (e.g., a KeyMod™ rail), persons of ordinary skill in the art will readily recognize that the systems and methods disclosed herein apply to many other types of accessory rails, such as standard Picatinny rails, modified Picatinny rails, or other modular external accessory rails or rails with keyhole configurations apart from the KeyMod™ rail.

Figure 10:
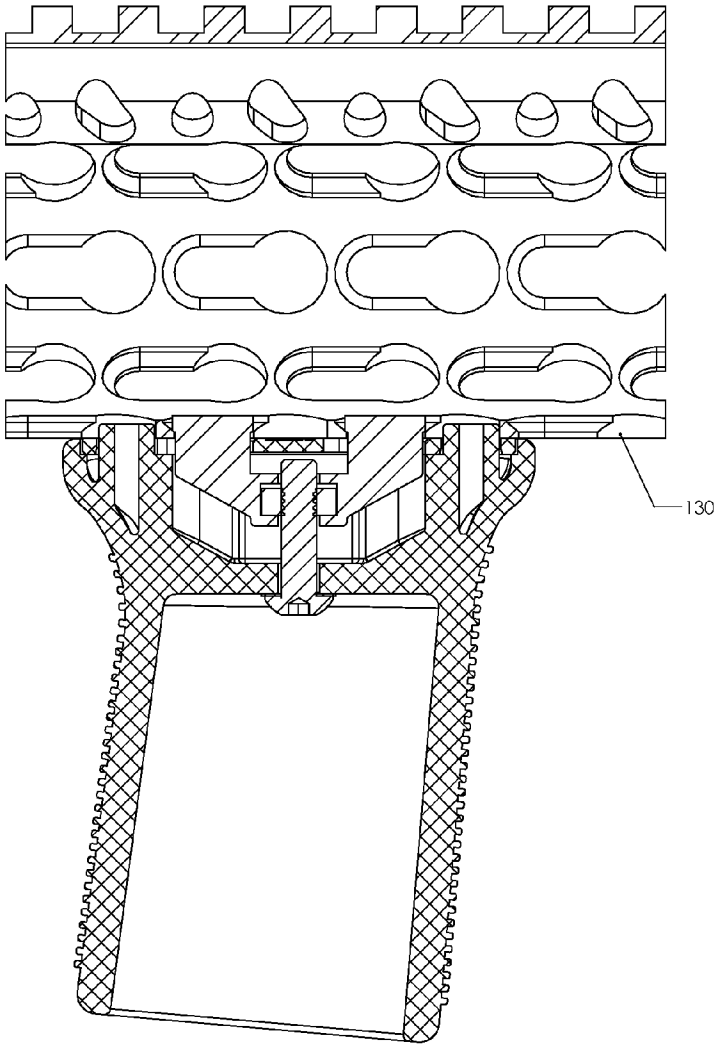
FIG. 10 is another cross-sectional side view of a vertical grip coupled to an external modular rail system by an exemplary system for coupling various types of firearm accessories to a firearm.

FIG. 10 is another cross-sectional side view of a vertical grip coupled to an external modular rail system by an exemplary system for coupling various types of firearm accessories to a firearm. FIG. 10 is similar to FIG. 9, except that it display more of firearm accessory rail 130 for illustrative purposes.

Figure 11A:
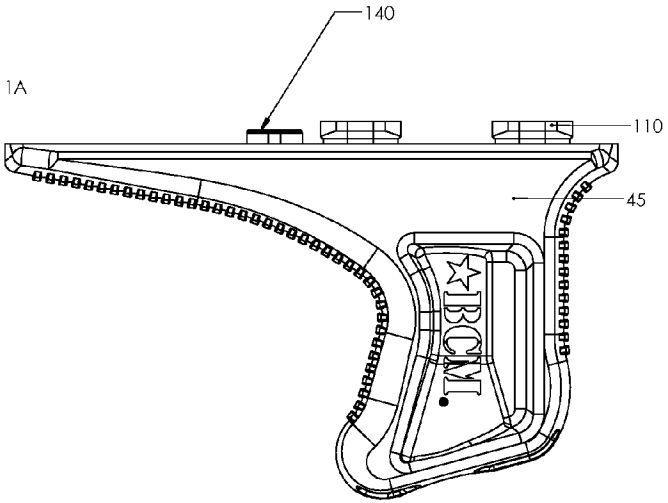
FIGS. 11A and 11B are, respectively, a side and cross-sectional side view of a handstop coupled to an exemplary system for coupling various types of firearm accessories to a firearm.
Figure 11B:
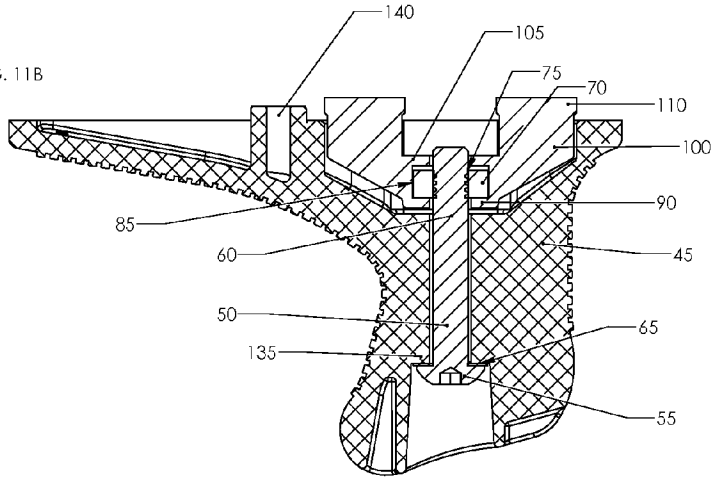

FIGS. 11A and 11B are, respectively, a side and cross-sectional side view of a handstop coupled to an exemplary system for coupling various types of firearm accessories to a firearm. FIG. 11B is similar to FIG. 9 as described above, except that in FIG. 11B the exemplary firearm accessory 45 being coupled to a firearm using an embodiment of the systems and methods disclosed herein is a handstop rather than a vertical grip.

Figure 12:
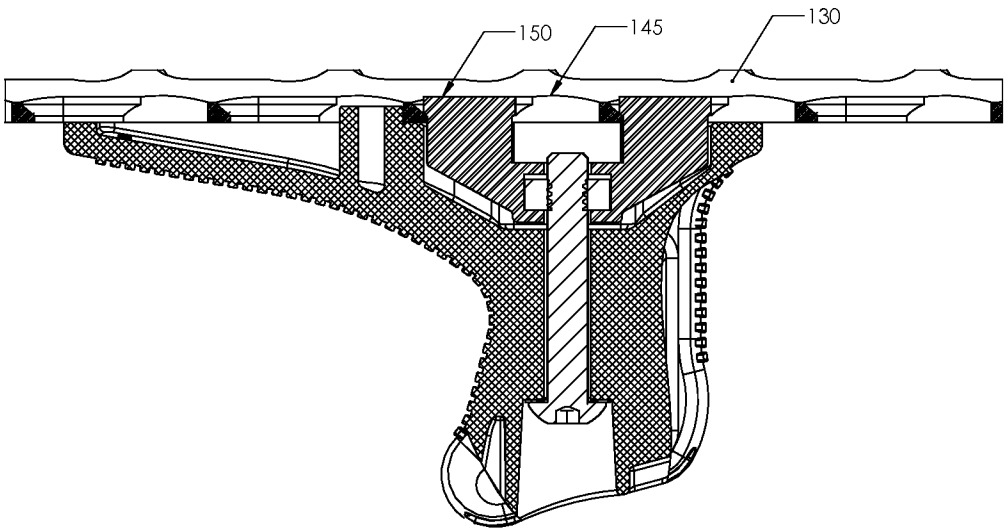
FIG. 12 is a cross-sectional side view of a handstop coupled to an external modular rail system by an exemplary system for coupling various types of firearm accessories to a firearm.

FIG. 12 is a cross-sectional side view of a handstop coupled to an external modular rail system by an exemplary system for coupling various types of firearm accessories to a firearm. FIG. 12 is similar to FIG. 11B, except that it displays firearm accessory rail 130 (including first region 145 and second region 150 of keyhole-shaped void 155).

Figure 13:
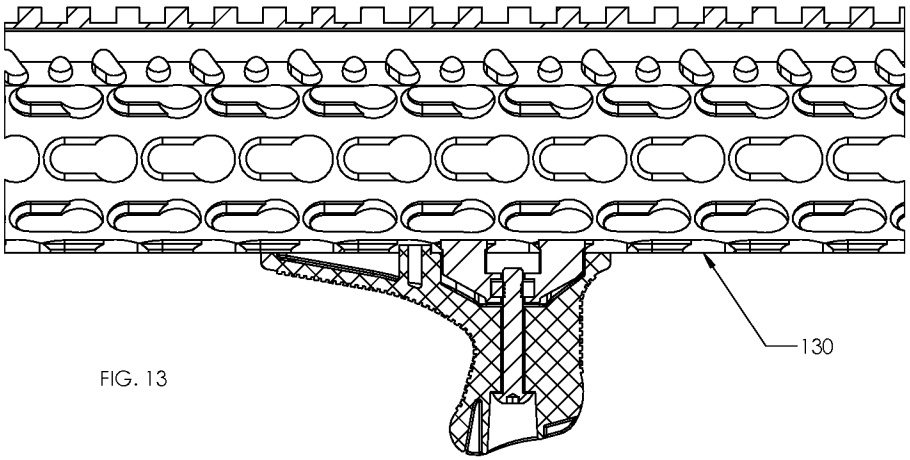
FIG. 13 is another cross-sectional side view of a handstop coupled to an external modular rail system by an exemplary system for coupling various types of firearm accessories to a firearm.

FIG. 13 is another cross-sectional side view of a handstop coupled to an external modular rail system by an exemplary system for coupling various types of firearm accessories to a firearm. FIG. 13 is similar to FIG. 12, except that it displays substantially more of firearm accessory rail 130 for illustrative purposes.

Figure 14B:
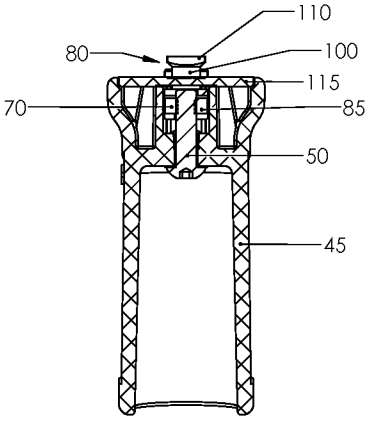
FIGS. 14A and 14B are, respectively, front and cross-sectional front views of a vertical grip coupled to an exemplary system for coupling various types of firearm accessories to a firearm.
Figure 14A:
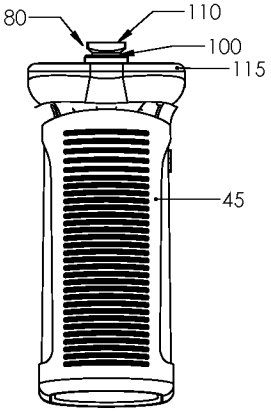

FIGS. 14A and 14B are, respectively, front and cross-sectional front views of a vertical grip coupled to an exemplary system for coupling various types of firearm accessories to a firearm. As shown in the exemplary embodiment of FIG. 14A, anchor 80 is partially visible. Namely, arm 100 with elongated surface 110 can be seen protruding from plug 115. As shown in FIG. 14B, which depicts the embodiment shown in FIG. 7A through a cross-section, the portion of anchor 80 disposed within vertical grip 45 beneath plug 115 is visible. Nut 70 and coupling member 50 are likewise visible.

Figure 15B:
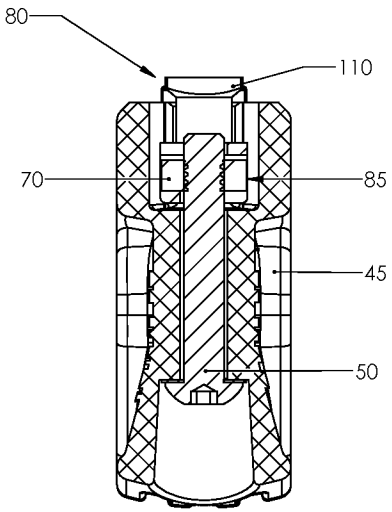
FIGS. 15A and 15B are, respectively, front and cross-sectional front views of a handstop coupled to an exemplary system for coupling various types of firearm accessories to a firearm.
Figure 15A:
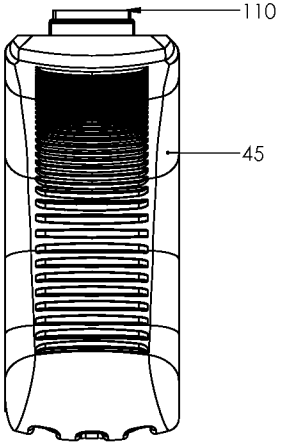

FIGS. 15A and 15B are, respectively, front and cross-sectional front views of a handstop coupled to an exemplary system for coupling various types of firearm accessories to a firearm. FIGS. 15A and 15B are similar to FIGS. 14A and 14B as described above, except that in FIGS. 15A and 15B the exemplary firearm accessory 45 being coupled to a firearm using an embodiment of the systems and methods disclosed herein is a handstop rather than a vertical grip.

Figure 16:
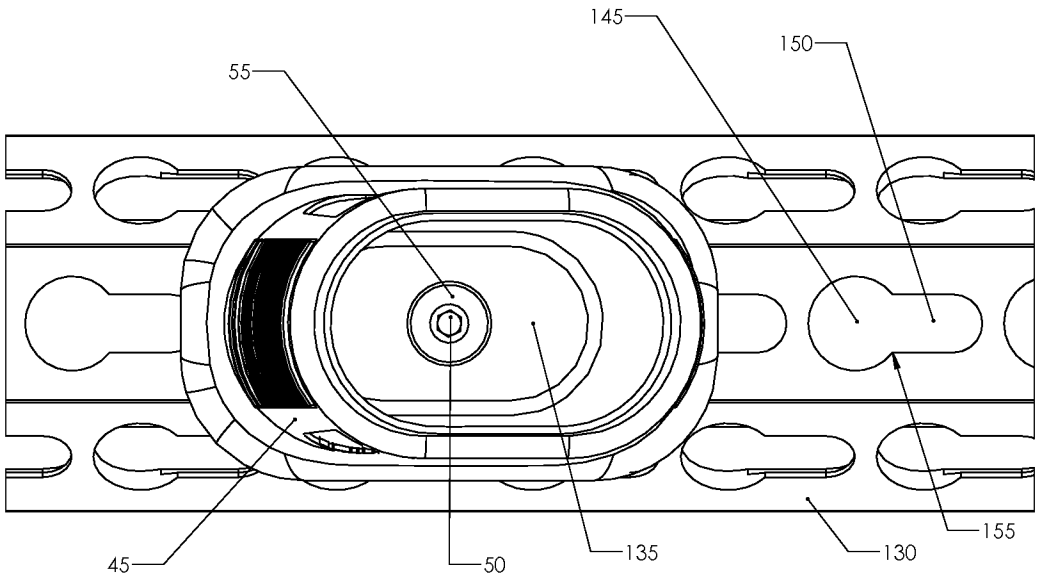
FIG. 16 is a bottom view of a vertical grip coupled to an external modular rail system by an exemplary system for coupling various types of firearm accessories to a firearm.

FIG. 16 is a bottom view of a vertical grip coupled to an external modular rail system by an exemplary system for coupling various types of firearm accessories to a firearm. As shown in FIG. 16, head 55 of coupling member 50 is securely tightened against interior wall 135 of vertical grip 45. Depending on the firearm accessory being coupled to firearm accessory rail 130 in accordance with the systems and methods described herein, coupling member 50 may be visible from a bottom view of the accessory as shown in FIG. 8, or it may be concealed by a hinged or removable panel that converts the interior of the firearm accessory into a storage compartment.

FIG. 16 also provides another clear view of voids 155 of firearm accessory rail 130 into which arms 100 of anchor 80 may be inserted when coupling an accessory (vertical grip 45 in the example shown in FIG. 16) to firearm accessory rail 130. First region 145 through which elongated surfaces 110 of arms 100 may pass and second region 150 through which elongated surfaces 110 of arms 100 may not pass (and therefore become abuttedly engaged with the surrounding surface area of firearm accessory rail 130 when coupling member 50 is sufficiently tightened) are visible.

Figure 17:
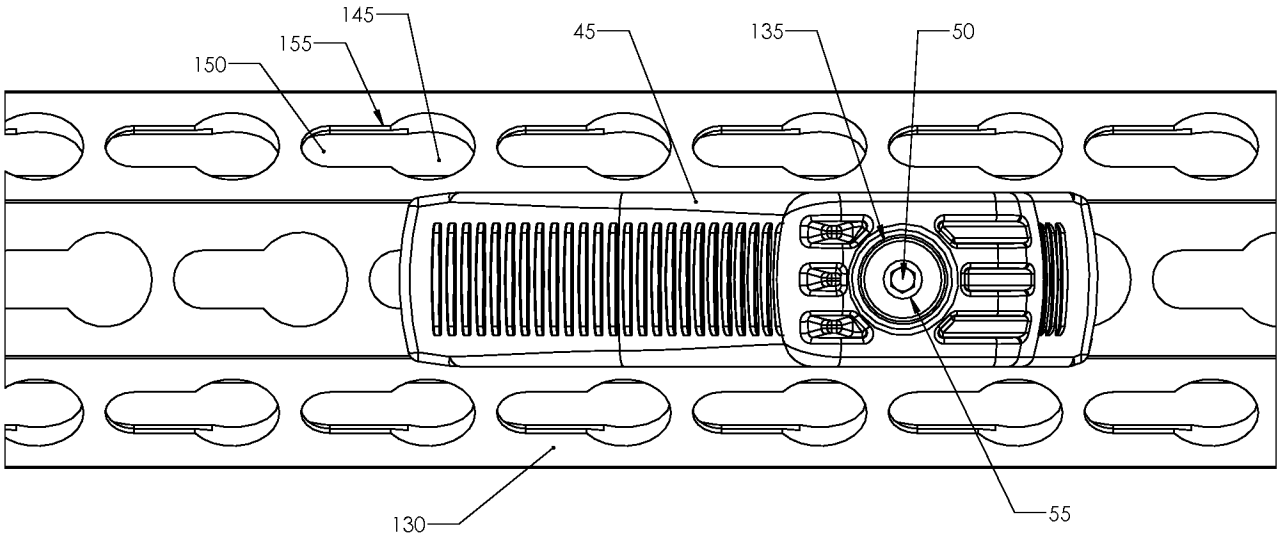
FIG. 17 is a bottom view of a vertical grip coupled to an external modular rail system by an exemplary system for coupling various types of firearm accessories to a firearm.

FIG. 17 is a bottom view of a vertical grip coupled to an external modular rail system by an exemplary system for coupling various types of firearm accessories to a firearm. FIG. 17 is similar to FIG. 16 as described above, except that in FIG. 17 the exemplary firearm accessory 45 being coupled to a firearm using an embodiment of the systems and methods disclosed herein is a handstop rather than a vertical grip.

As noted above, although certain embodiments of systems and methods are discussed in this disclosure, it should be understood that those particular embodiments are exemplary and non-exhaustive. The embodiments depicted and discussed in this disclosure were selected in an attempt to most clearly convey the inventive concepts. Persons of ordinary skill in the art will readily recognize and appreciate that the present disclosure suggests many other possible embodiments in addition to those expressly described herein. For instance, although the foregoing embodiments were described in the context of coupling exemplary accessories (e.g., a vertical grip and a handstop) to an external modular rail system with a keyhole configuration (e.g. a KeyMod™ rail), it should be readily apparent to persons of ordinary skill in the art that the systems and methods described herein are equally suitable for coupling other accessories, such as flashlights, supplemental rail panels, or any number of other firearm accessories. It should also be readily apparent to persons of ordinary skill in the art that the methods and system described herein are equally applicable to other types of accessory rails. One such additional rail, among many others, is the standard Picatinny rail.

Figure 18B:
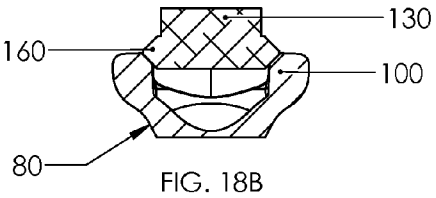
FIGS. 18A and 18B are, respectively, an exploded isometric view of an exemplary system for coupling various types of firearm accessories to a firearm and a cross-sectional front view of an exemplary anchor coupled to a Picatinny rail.
Figure 18A:
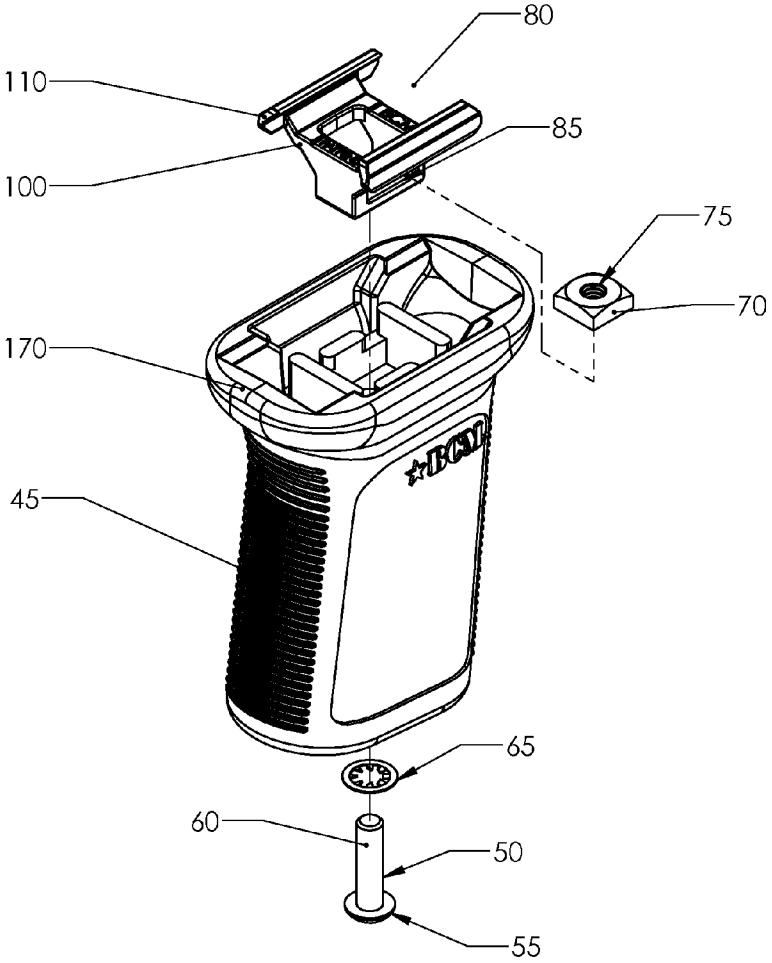

FIGS. 18A and 18B are, respectively, an exploded isometric view of an exemplary system for coupling various types of firearm accessories to a firearm and a cross-sectional front view of an exemplary anchor coupled to a Picatinny rail.

In FIG. 18A, as in FIG. 2, exemplary system 40 is shown in connection with vertical grip 45 for illustrative purposes and to provide suitable context. It should be understood that vertical grip 45 is merely an exemplary firearm accessory and that any number of other accessories could have been selected to provide context.

System 40 may include a coupling member 50. Coupling member 50 may be a screw, bolt, or other suitable fastener, and may include a head 55 attached to a body 60. Body 60 may be threaded in some embodiments. Head 55 may include a drive region into which a screwdriver or other tool may be inserted and used to drive coupling member 50. In some embodiments, system 40 may include a washer 65 through which body 60 of coupling member 50 may pass. System 40 may include a nut 70, which in some embodiments (like that shown in FIG. 2), may be square in shape. Nut 70 may include a void 75 sized to mate with body 60 of coupling member 50. Where body 60 of coupling member is threaded, so too may the void in nut 70 be correspondingly threaded to facilitate an appropriate mating between the two components.

System 40 may include an anchor 80. Anchor 80 may take a variety of shapes (e.g., Y-shaped or U-shaped). The shape of anchor 80 is any given embodiment will depend on various design considerations, including which type of firearm accessory rail to which anchor 80 will couple the firearm accessory. Persons of ordinary skill in the art will notice, for instance, that the shape of anchor 80 depicted and described with respect to FIG. 2 (in which the exemplary firearm accessory rail 130 is a modular external rail system with a keyhole configuration) differs from the shape of anchor 80 depicted and described with respect to FIG. 18A (in which the exemplary firearm accessory rail 130 is a Picatinny rail).

In one embodiment, as shown in FIG. 18A, anchor 80 may include a slot 85 into which nut 70 may be seated. Where nut 70 is square, slot 85 may likewise be square to ensure that nut 70 is tightly seated. In such cases, square nut 70 may eliminate the need for threads in anchor 80. Alternatively, rather than utilizing slot 85 and correspondingly shaped square nut 70, anchor 80 may include a tapped or threaded hole. Slot 85 may be partially formed by a bottom surface 90 of anchor 80. Bottom surface 90 may include a void 95 sized to mate with body 60 of coupling member 50. Bottom surface 90 and void 95 are concealed from view in FIG. 18A, but are visible in FIG. 20A. Void 95 may be a singular round thru-hole, a tapped hole, a threaded hole, or a U-shaped slot.

When nut 70 is properly seated within slot 85, void 95 of bottom surface 90 may align with void 75 of nut 70 such that coupling member 50, when driven or tightened, may engage nut 70 and pull nut 70 toward coupling member 50, which itself may be seated against an interior wall of vertical grip 45 (as shown later in FIG. 25B). When coupling member 50 is seated within vertical grip 45 such that body 60 of coupling member 50 may pass through a void in an internal wall of vertical grip 45 but head 55 of coupling member 50 may not pass through the void in the internal wall, driving or tightening coupling member 50 effectively pulls nut 70 toward coupling member 50. Because nut 70 is securely seated within slot 85 of anchor 80, anchor 80 is likewise pulled toward coupling member 45. Coupling member 45 may be driven or tightened until nut 70 and, by extension, anchor 80 are securely engaged against an interior wall of vertical grip 45.

Anchor 80 may further include a plurality of arms 100. As shown in FIG. 18B, anchor 80 may be a solid, single component that includes both slot 85, bottom surface 90, void 95, arms 100, and an upper surface 105 from which arms 100 extend. Anchor 80 may be molded or otherwise created as a solid, single component or it may be created by attaching or coupling sub-components together, such as attaching arms 100 to a slotted box containing slot 85, bottom surface 90, void 95, and an upper surface 105. In some embodiments, arms 100 may each include, at a distal end, an elongated surface 110 oriented at an angle with respect to arm 100. Elongated surface 110 may be "elongated" in the sense that it has a surface area greater than the cross-sectional area of arm 100 or may extend beyond arm 100. As shown in the exemplary embodiment of FIG. 18A, anchor 80 includes two arms 100 disposed opposite one another. Elongated surface 110 of each arm 100 is coupled to arm 100 at an angle such that, together, the two oppositely situated and angled surfaces 110 effectively form a claw. Each elongated surface 110 effectively forms a ridge, rim, or lip with respect to arm 100. In operation, as coupling member 50 is tightened, it draws anchor 80 towards itself and creates tension between elongated surfaces 110 and the surface of firearm accessory rail 130 (a Picatinny rail, as shown in this exemplary scenario).

FIG. 18B shows an alternative embodiment of anchor 80. Unlike the embodiment of anchor 80 shown in FIG. 18A, the embodiment of FIG. 18B does not include elongated surfaces 110. Rather, arms 100 contained angled surfaces that correspond to angles surfaces of firearm accessory rail 130. As a result, in operation, as coupling member 50 is tightened, it draws anchor 80 towards itself and creates tension between the corresponding angles surfaces of arms 100 and firearm accessory rail 130.

Figure 19B:
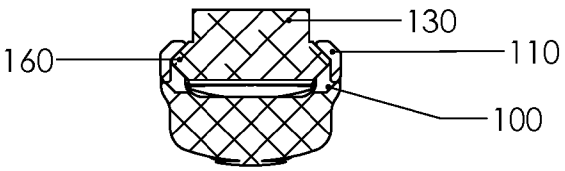
FIGS. 19A and 19B are, respectively, an additional exploded isometric view of an exemplary system for coupling various types of firearm accessories to a firearm and an additional cross-sectional front view of an exemplary anchor coupled to a Picatinny rail.
Figure 19A:
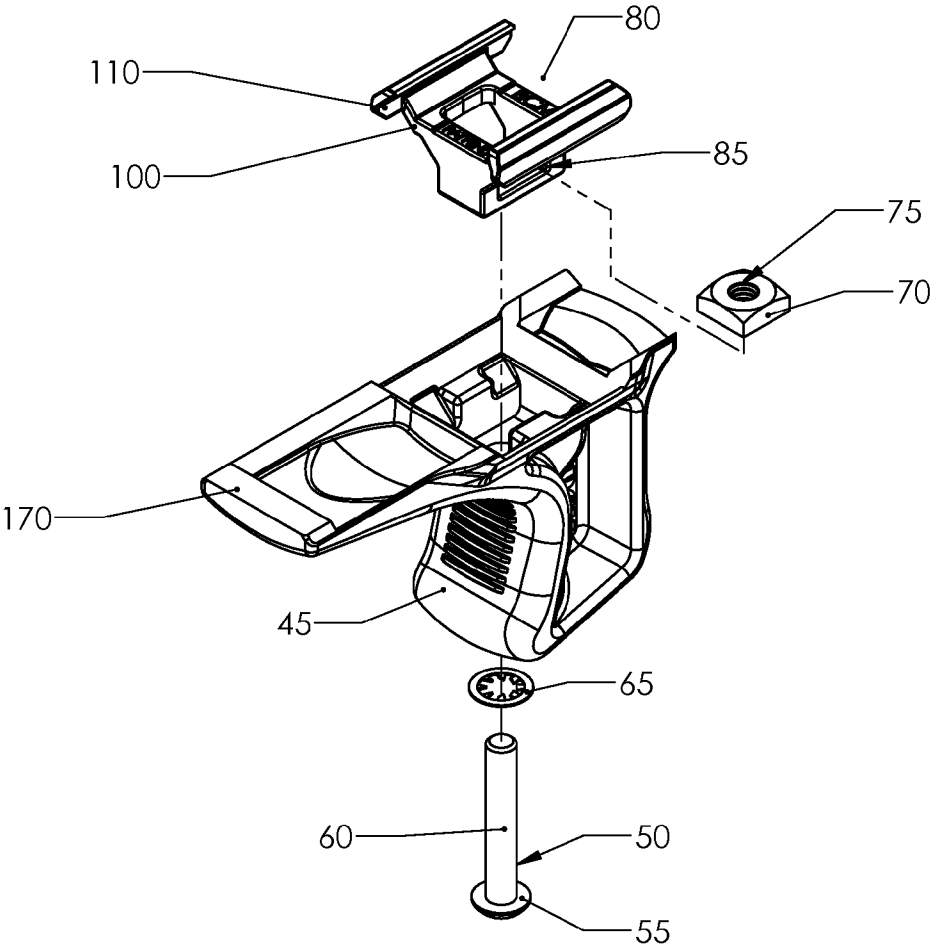

FIGS. 19A and 19B are, respectively, an additional exploded isometric view of an exemplary system for coupling various types of firearm accessories to a firearm and an additional cross-sectional front view of an exemplary anchor coupled to a Picatinny rail. FIGS. 19A and 19B are similar to FIGS. 18A and 18B as described above, except that in FIGS. 19A and 19B the exemplary firearm accessory 45 being coupled to a firearm using an embodiment of the systems and methods disclosed herein is a handstop rather than a vertical grip.

Figure 20C:
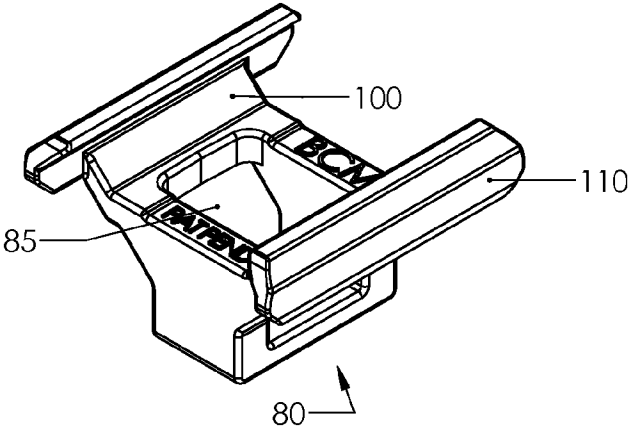
FIGS. 20A-20C are, respectively, top, front, and isometric views of an exemplary anchor.
Figure 20A:
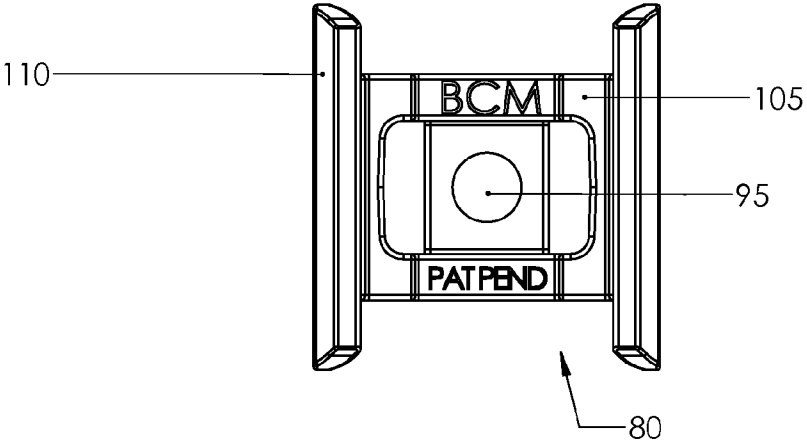
Figure 20B:
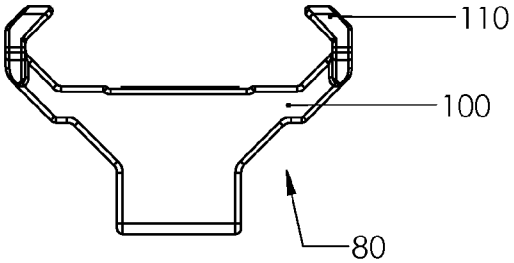

FIGS. 20A-20C are, respectively, top, front, and isometric views of an exemplary anchor. The various views of anchor 80 show slot 85, bottom surface 90, void 95, arms 100, upper surface 105, and elongated surfaces 110.

Figure 21:
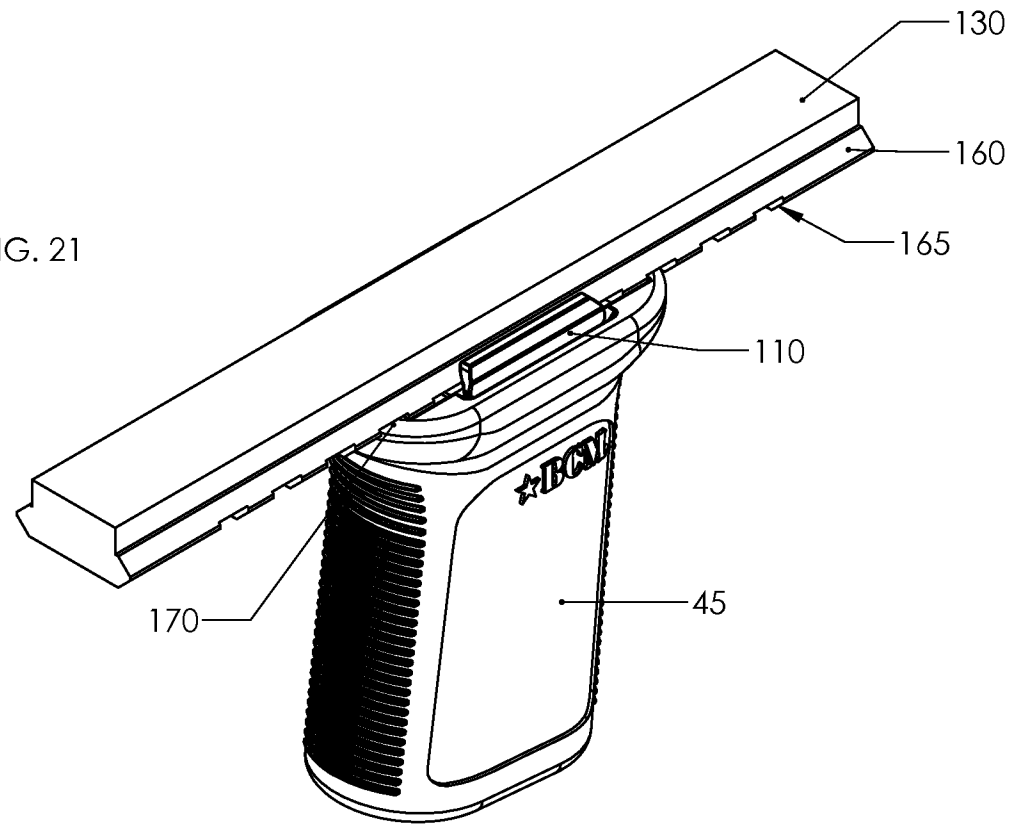
FIGS. 21 and 22 are, respectively, an isometric and side view of a vertical grip coupled to a Picatinny rail by an exemplary system for coupling various types of firearm accessories to a firearm
Figure 22:
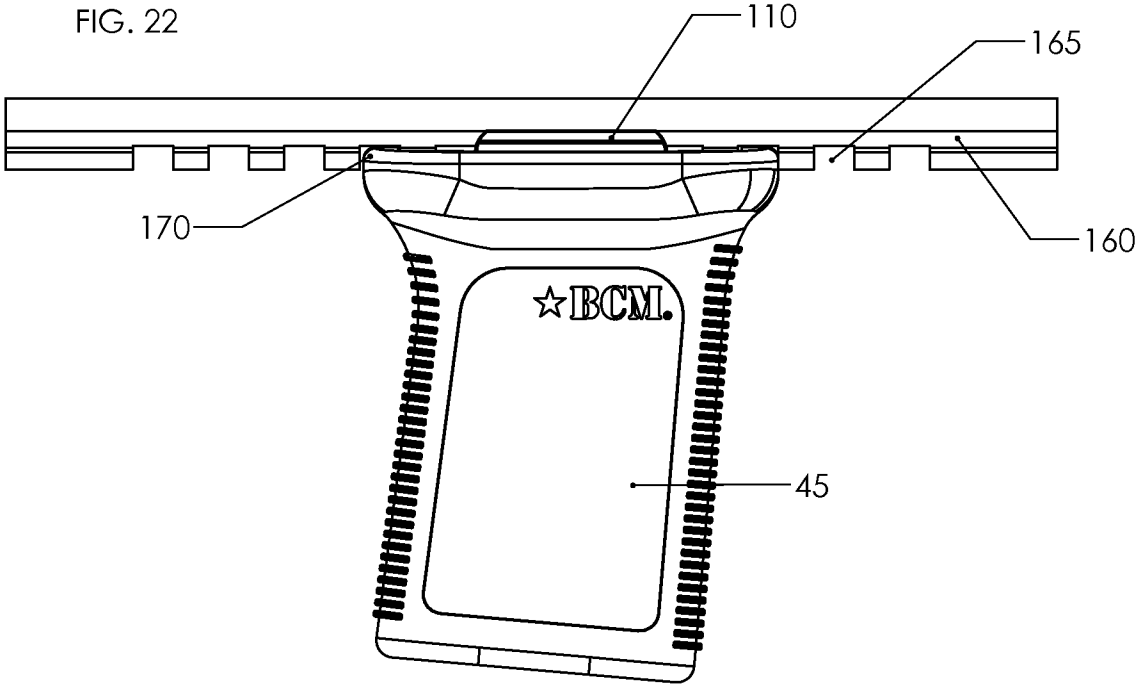

FIGS. 21 and 22 are, respectively, an isometric and side view of a vertical grip coupled to a Picatinny rail by an exemplary system for coupling various types of firearm accessories to a firearm. As shown in FIG. 21, in one embodiment, system 40 may couple a firearm accessory such as vertical grip 45 to a firearm accessory rail 130. In the illustrative embodiment shown in FIG. 21, firearm accessory rail 130 is a Picatinny rail. As illustrated previously, any type of rail system may be used in connection with embodiments of system 40, including a modular external rail system with a keyhole configuration (e.g., a KeyMod™ rail). It should be understood that, in practice, firearm accessory rail 130 itself is coupled to the firearm that the firearm accessory at issue is designed to enhance. To clearly illustrate the inventive concepts disclosed herein without unnecessarily diluting the focus of the present disclosure, only the accessory rail is shown.

Figure 23:
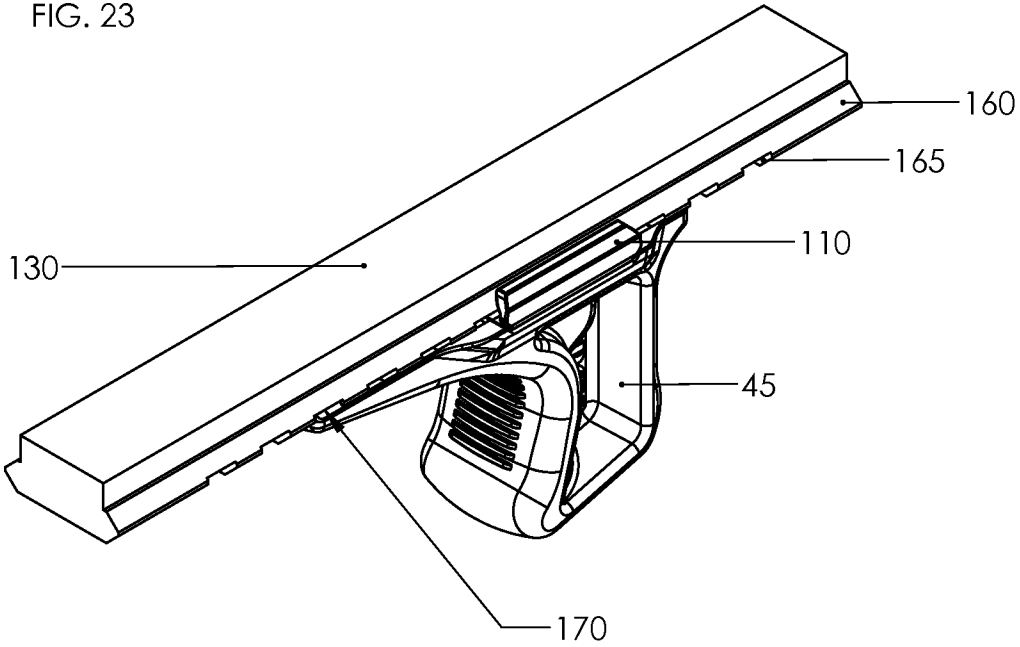
FIGS. 23 and 24 are, respectively, an isometric and side view of a handstop coupled to a Picatinny rail by an exemplary system for coupling various types of firearm accessories to a firearm.
Figure 24:
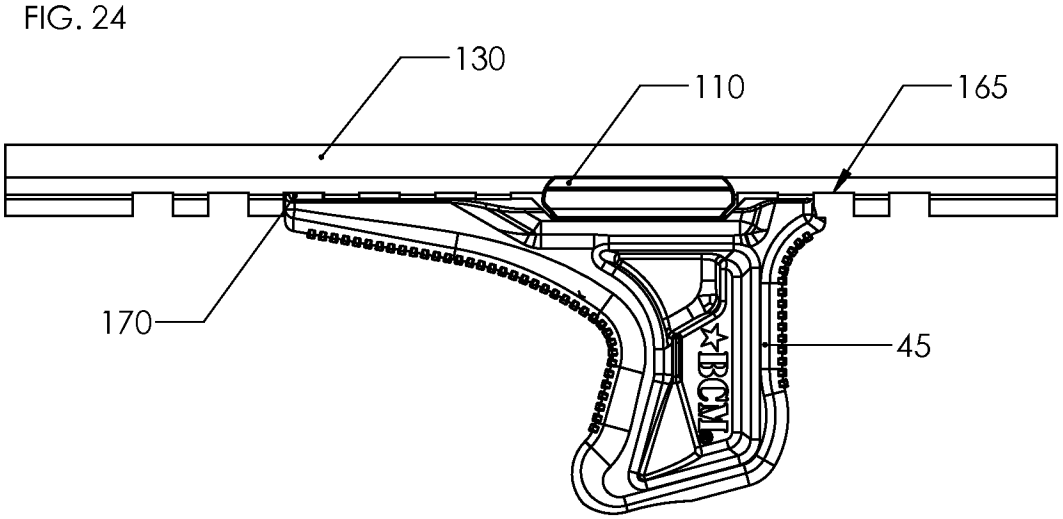

FIGS. 23 and 24 are, respectively, an isometric and side view of a handstop coupled to a Picatinny rail by an exemplary system for coupling various types of firearm accessories to a firearm. FIGS. 23 and 24 are similar to FIGS. 21 and 22 as described above, except that in FIGS. 23 and 24 the exemplary firearm accessory 45 being coupled to a firearm using an embodiment of the systems and methods disclosed herein is a handstop rather than a vertical grip.

Figure 25A:
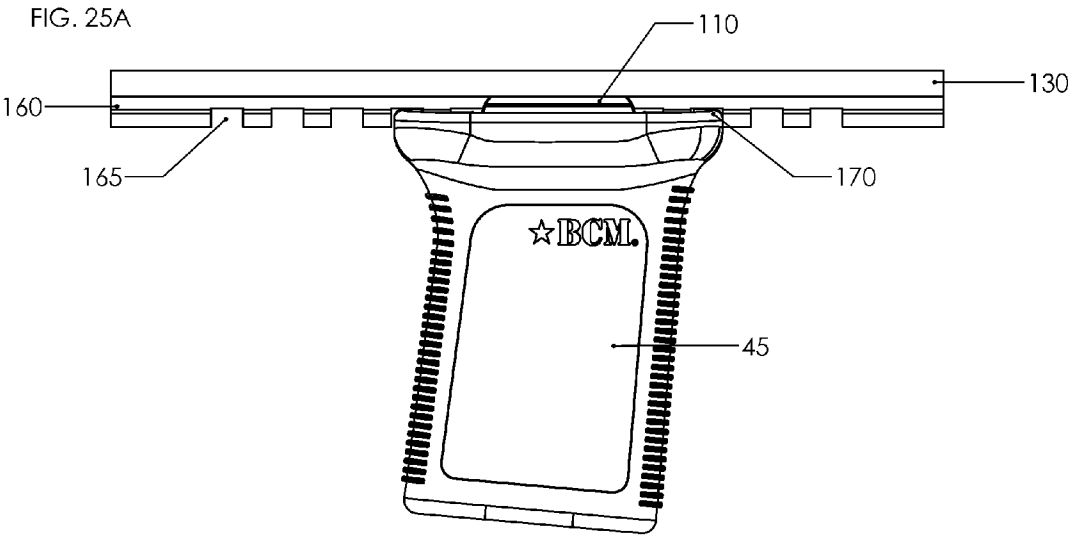
FIGS. 25A and 25B are, respectively, a side and cross-sectional side view of a vertical grip coupled to a Picatinny rail by an exemplary system for coupling various types of firearm accessories to a firearm.
Figure 25B:
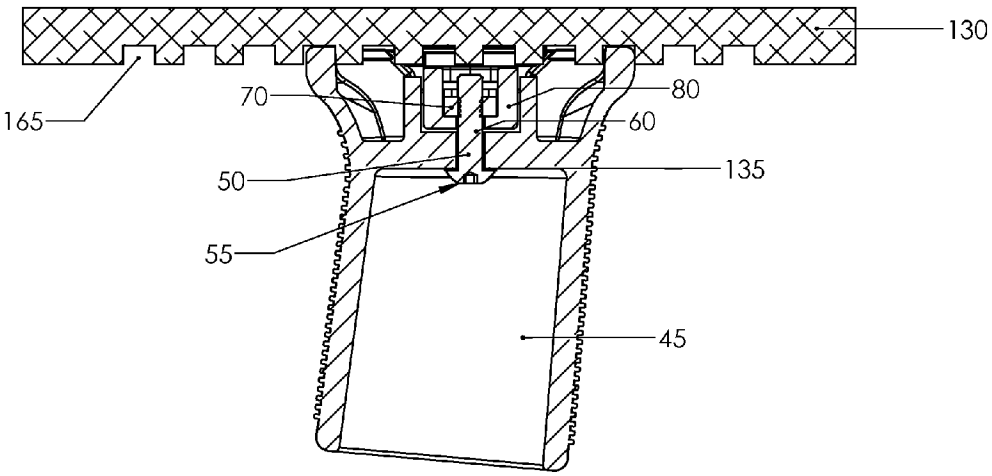

FIGS. 25A and 25B are, respectively, a side and cross-sectional side view of a vertical grip coupled to a Picatinny rail by an exemplary system for coupling various types of firearm accessories to a firearm. In one embodiment, system 40 may couple a firearm accessory such as vertical grip 45 to firearm accessory rail 130. As previously noted, vertical grip 45 is depicted for illustrative purposes and is merely an exemplary firearm accessory with which system 40 may be used. System 40 may couple any number of firearm accessories to firearm accessory rail 130, such as handstops, flashlights, scopes, supplemental rail panels, optical aiming devices (e.g., infrared/laser sights), bipods, or any other desired accessories.

As depicted in the exemplary scenario of FIGS. 25A and 25B, coupling member 50 is a threaded screw and includes head 55 attached to threaded body 60. Head 55 includes a drive region used to tighten coupling member 50. System 40 includes a washer 65 through which body 60 of coupling member 50 passes. System 40 also includes square nut 70, which itself includes void 75 sized to mate with body 60 of coupling member 50. Void 75 in nut 70 is correspondingly threaded to facilitate an appropriate mating between nut 70 and coupling member 50.

System 40 includes anchor 80. Anchor 80 includes slot 85 into which nut 70 is seated. Because slot 85 is square like nut 70, nut 70 is tightly seated. Slot 85 is partially formed by bottom surface 90 of anchor 80. Bottom surface 90 includes void 95 sized to mate with body 60 of coupling member 50. Void 95 of bottom surface 90 is aligned with void 75 of nut 70 and coupling member 50 has engaged nut 70 and pulled nut 70 toward coupling member 50. Coupling member 50 is abuttedly engaged with an interior wall 135 of vertical grip 45. As shown in FIG. 9, because coupling member 50 was abuttedly engaged with vertical grip 45 such that body 60 of coupling member 50 could pass through a void in internal wall 135 of vertical grip 45 but head 55 of coupling member 50 could not, coupling member 50, when tightened, effectively pulled nut 70 toward coupling member 50. Because nut 70 is securely seated within slot 85 of anchor 80, anchor 80 was likewise pulled toward coupling member 45. Coupling member 45 was then tightened until nut 70 and, by extension, anchor 80 became securely engaged against an opposite side of interior wall 135 (or any other suitable surface) within vertical grip 45.

Anchor 80 includes two arms 100. As shown in FIGS. 25A and 25B, anchor 80 includes both slot 85, bottom surface 90, void 95, arms 100, and upper surface 105 from which arms 100 extend. As shown in FIG. 25A, arms 100 each include, at a distal end, elongated surface 110 oriented at an angle with respect to arm 100. Notably, elongated surfaces 110 are not visible in FIG. 25B like they are in FIG.

25A due to the cross-sectional perspective of FIG. 25B. As previously discussed, elongated surface 110 is "elongated" in the sense that it forms an extended ridge, rim, or lip with respect to arm 100.

In the exemplary embodiment shown in FIGS. 25A and 25B, firearm accessory rail 130 is a Picatinny rail. Any type of rail system may be used in connection with embodiments of system 40, including an external modular rail system featuring a keyhole configuration (e.g., a KeyMod™ rail). Referring back to FIGS. 21 and 22, in which firearm accessory rail 130 is a Picatinny rail like firearm accessory rail 130 shown in FIGS. 25A and 26B, firearm accessory rail 130 may include one or more angled surfaces 160. Angled surfaces 160 may be disposed on the sides of firearm accessory rail 130. In some cases, angled surfaces 160 may be angled with a downward slope, while in others angled surfaces 160 may be angled with an upward slope. In the case of the standard Picatinny rail 130 shown in FIGS. 21 and 22, both types of angles surfaces 160 may be present. Namely, an angled surface 160 with an upward slope may be disposed above an angled surface 160 with a downward slope along the underside of firearm accessory rail 130 so as to create the "rail" segment to which system 40 may be coupled. Firearm accessory rail 130 may further include a plurality of grooves 165 with which various components or parts of components associated with a firearm accessory or system 40 may be mated.

As shown in FIGS. 21, 22, and 25A-25B, elongated surfaces 110 of anchor 80 may, when coupling member 50 is not fully tensioned against an interior wall of the firearm accessory (such as vertical group 45) by nut 70, be positioned over angled surfaces 160 of firearm accessory rail 130. In the fully engaged configuration shown in FIGS. 21 and 22, coupling member 45 has been then tightened until anchor 80 has become securely engaged with firearm accessory rail 130 by virtue of anchor 80 being pulled towards head 55 of coupling member 50 while at the same time having elongated surfaces 110 of arms 100 abuttedly engaged with angled surfaces 160 of firearm accessory rail 130. In effect, elongated surfaces 110 are pulled in tension and "grab" the rail segment formed by angled surfaces 160.

Certain firearm accessories may include surfaces designed to serve as the recoil lugs 140 previously described with respect to FIG. 9. For instance, in the exemplary scenario depicted in FIGS. 21, 22, and 25A-25B, body segments 170 of vertical grip 45 serve as recoil lugs when system 40 is in its fully engaged configuration (i.e., when coupling member 50 is fully tightened to bring anchor 80 into tension with vertical grip 45 and firearm accessory rail 130). Namely, body segments 170 are oriented such that, when firearm accessory 45 is properly coupled to firearm accessory rail 130 using the method and systems disclosed herein, each body segment 170 rests snugly against an inner edge of groove 165 of firearm accessory rail 130. In some embodiments, body segments 170 may be slightly offset from the inner edge of groove 165 such that the pressure resulting from tightening coupling member 50 and the resultant pull on anchor 80 makes body segments 170 snap into place against the inner edge. Body segments 170, acting as recoil lugs akin to recoil lug 140 of FIG. 9, may help to stabilize firearm accessory 45 against natural component stress caused by firearm recoil. More particularly, body segments 170 may help to transfer some of the stress forces caused by firearm recoil away from coupling member 50. In that way, body segments 170 may help to prolong the life of coupling member 50.

Figure 26A:
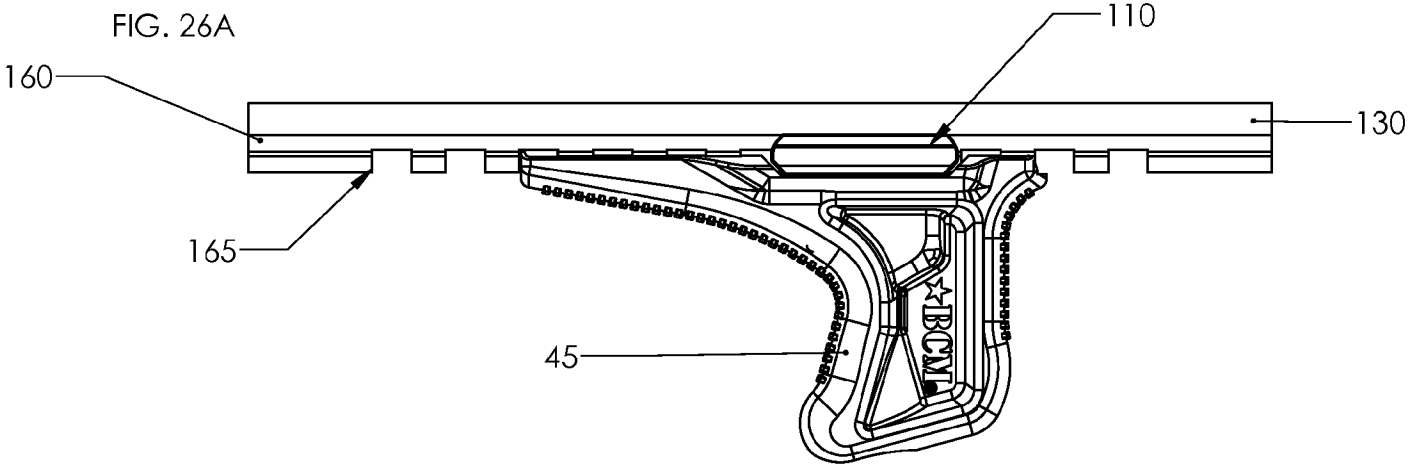
FIGS. 26A and 26B are, respectively, a side and cross-sectional side view of a handstop coupled to a Picatinny rail by an exemplary system for coupling various types of firearm accessories to a firearm.
Figure 26B:
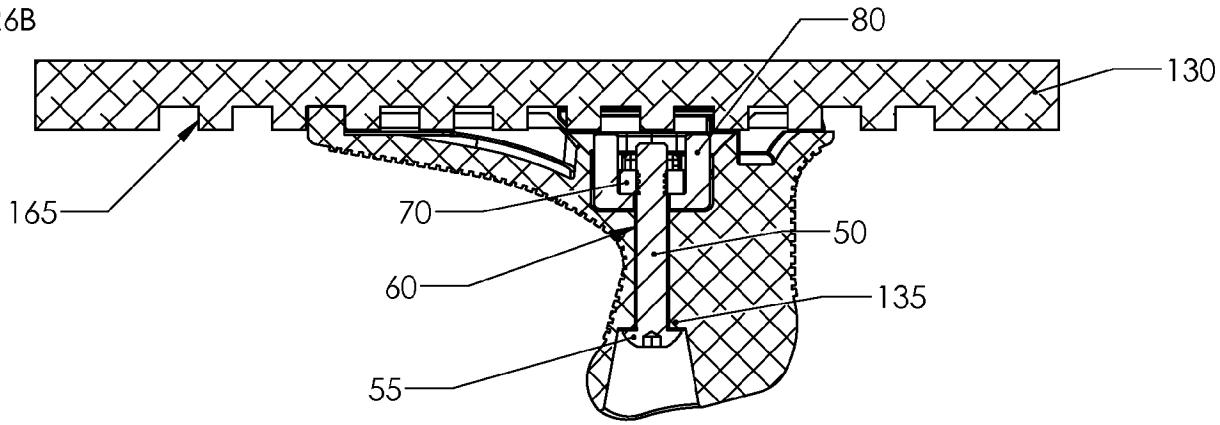

FIGS. 26A and 26B are, respectively, a side and cross-sectional side view of a handstop coupled to a Picatinny rail by an exemplary system for coupling various types of firearm accessories to a firearm. FIGS. 26A and 26B are similar to FIGS. 25A and 25B as described above, except that in FIGS. 26A and 26B the exemplary firearm accessory 45 being coupled to a firearm using an embodiment of the systems and methods disclosed herein is a handstop rather than a vertical grip.

Figure 27B:
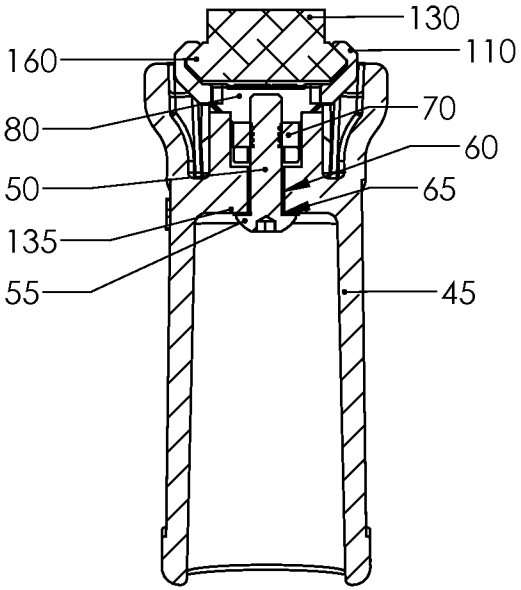
FIGS. 27A and 27B are, respectively, front and cross-sectional front views of a vertical grip coupled to a Picatinny rail by an exemplary system for coupling various types of firearm accessories to a firearm.
Figure 27A:
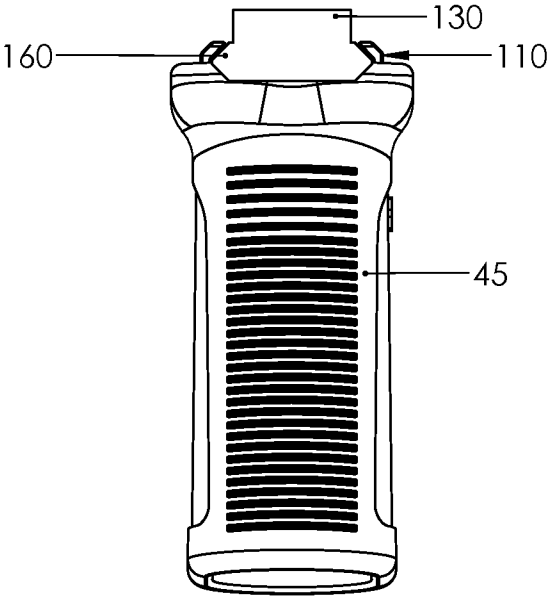

FIGS. 27A and 27B are, respectively, front and cross-sectional front views of a vertical grip coupled to a Picatinny rail by an exemplary system for coupling various types of firearm accessories to a firearm. As shown in the exemplary embodiment of FIG. 27A, anchor 80 is partially visible. Namely, elongated surfaces 110 can be seen in tension with or "grabbing" angled surfaces 160 of firearm accessory rail 130. As shown in FIG. 14B, which depicts the embodiment shown in FIG. 27A through a cross-section, the portion of anchor 80 disposed within the interior of vertical grip 45 is visible. Nut 70 and coupling member 50 are likewise visible.

Figure 28B:
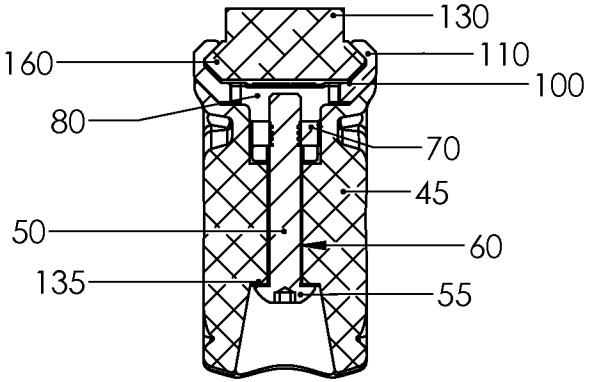
FIGS. 28A and 28B are, respectively, front and cross-sectional front views of a handstop coupled to a Picatinny rail by an exemplary system for coupling various types of firearm accessories to a firearm
Figure 28A:
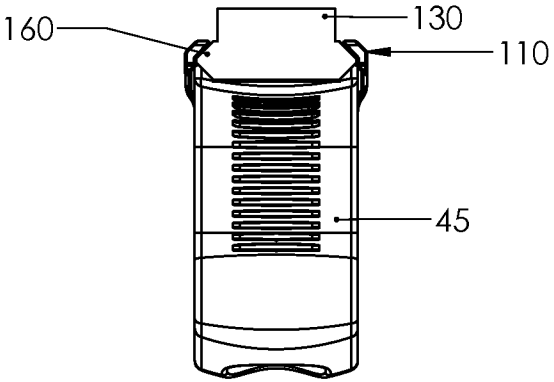

FIGS. 28A and 28B are, respectively, front and cross-sectional front views of a handstop coupled to a Picatinny rail by an exemplary system for coupling various types of firearm accessories to a firearm. FIGS. 28A and 28B are similar to FIGS. 27A and 27B as described above, except that in FIGS. 28A and 28B the exemplary firearm accessory 45 being coupled to a firearm using an embodiment of the systems and methods disclosed herein is a handstop rather than a vertical grip.

Figure 29:
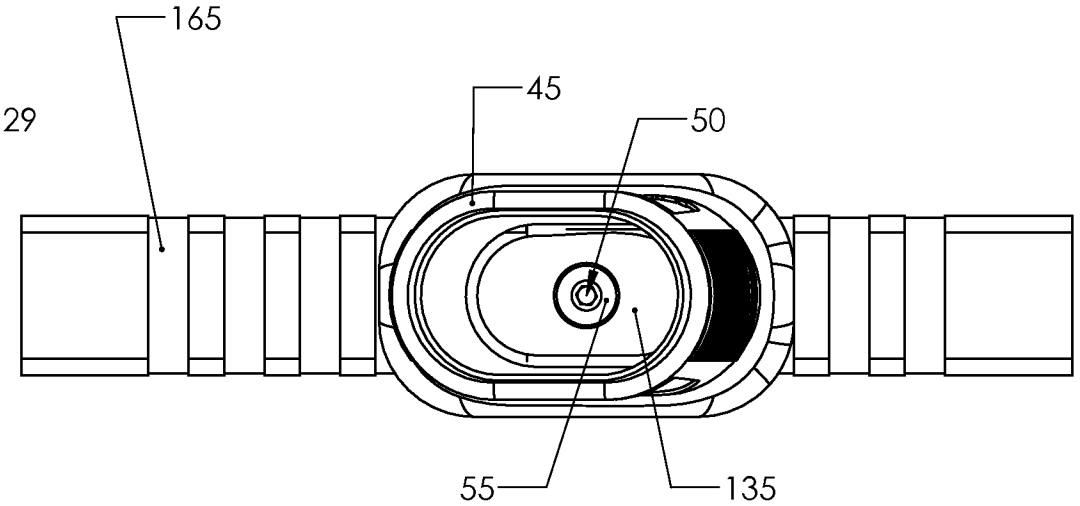
FIG. 29 is a bottom view of a vertical grip coupled to a Picatinny rail by an exemplary system for coupling various types of firearm accessories to a firearm.

FIG. 29 is a bottom view of a vertical grip coupled to a Picatinny rail by an exemplary system for coupling various types of firearm accessories to a firearm. As shown in FIG. 29, head 55 of coupling member 50 is securely tightened against interior wall 135 of vertical grip 45. Depending on the firearm accessory being coupled to firearm accessory rail 130 in accordance with the systems and methods described herein, coupling member 50 may be visible from a bottom view of the accessory as shown in FIG. 8, or it may be concealed by a hinged or removable panel.

FIG. 29 also provides another clear view of grooves 165 of firearm accessory rail 130 into which body segments 170 may be inserted to serve as recoil lugs when coupling an accessory (vertical grip 45 in the example shown in FIG. 29) to firearm accessory rail 130.

Figure 30:
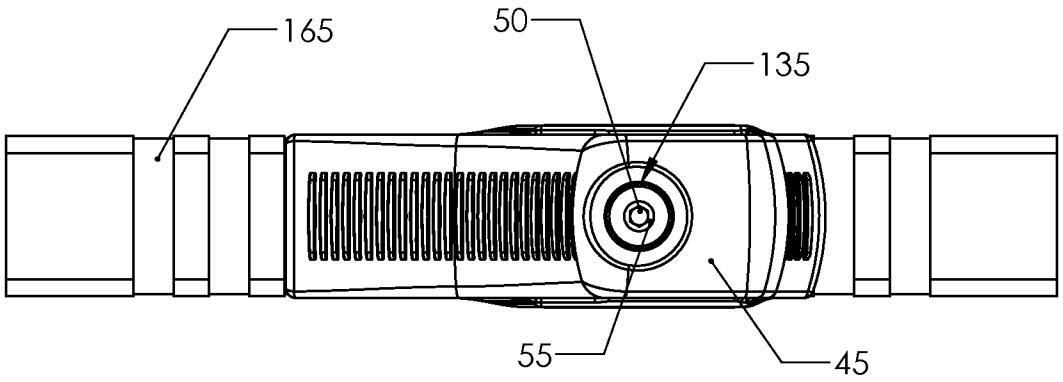
FIG. 30 is a bottom view of a handstop coupled to a Picatinny rail by an exemplary system for coupling various types of firearm accessories to a firearm.

FIG. 30 is a bottom view of a handstop coupled to a Picatinny rail by an exemplary system for coupling various types of firearm accessories to a firearm. FIG. 30 is similar to FIG. 29 as described above, except that in FIG. 19 the exemplary firearm accessory 45 being coupled to a firearm using an embodiment of the systems and methods disclosed herein is a handstop rather than a vertical grip.

The vertical grips, handstops, handguards, and other accessories illustrated herein may each be low-profile in length for increased mobility and to decrease the chances of the accessories becoming snagged on other equipment or objects in the surrounding environment. Using the systems and methods described herein, such accessories may be mounted at various angles, including being angled forward or having a reverse angle with respect to a front of the firearm accessory rail. Being angled in a forward direction may increase the rigidity of the firearm while providing a more natural wrist angle. Being mounted in a reverse angle may increase control when grabbing an accessory such as a vertical grip, a handstops, a handguard, or similar accessory. The accessories may each include flat sides with an textured surface to provide better yaw control to a shooter during firing and non-firing manipulations. The accessories may be composed of a variety of suitable materials, including impact resistant polymers, plastics, metal, wood, or a combination of such materials.

The above description is illustrative and not restrictive. Many variations of the invention will become apparent to those of skill in the art upon review of this disclosure. While the present invention has been described in connection with a variety of embodiments, these descriptions are not intended to limit the scope of the invention to the particular forms set forth herein. Specifically, as noted above, although embodiments are described in the context of coupling exemplary accessories (e.g., a vertical grip, a handstop, etc.) to various types of firearm accessory rails (e.g., an external modular rail system with a keyhole configuration, a Picatinny rail, etc.), it should be readily apparent to persons of ordinary skill in the art that the systems and methods described herein are equally suitable for coupling other accessories, such as flashlights, supplemental rail panels, or any number of other firearm accessories. It should also be readily apparent to persons of ordinary skill in the art that the methods and system described herein are equally applicable to other types of accessory rails aside from the exemplary external modular rail system and Picatinny rail depicted in the present disclosure. In other words, it is contemplated that the system and methods disclosed herein may be used to attach any firearm accessory to any type of accessory rail. The foregoing description is intended to cover alternatives, modifications, and equivalents as may be included within the spirit and scope of the invention as defined by the appended claims and otherwise appreciated by one of ordinary skill in the art.

What is claimed is:

1. A connector for coupling a firearm accessory to a firearm, the connector comprising:

an anchor configured to couple a firearm accessory to a firearm accessory rail of a firearm, the anchor including a plurality of arms and a slot;

a nut housed within the slot;

a coupling member configured to couple the anchor to the firearm accessory rail when inserted into the nut through a bottom end of the firearm accessory and tightened until the anchor is pulled into tension with both the firearm accessory and the firearm accessory rail; and a plug configured to cover an exposed region of the firearm accessory while permitting a portion of each arm of the anchor to protrude from the plug and couple to the firearm accessory rail.

2. The connector of claim 1, wherein the nut and the slot in the anchor are each square.

3. The connector of claim 1, wherein the plurality of arms are opposite one another.

4. The connector of claim 3, wherein each of the plurality of arms includes a surface that forms a lip with respect to a distal end of the arm.

5. The connector of claim 1, wherein the anchor is Y-shaped and formed from as a unitary component.

6. The connector of claim 4, wherein the firearm accessory rail includes a plurality of keyhole-shaped voids and the lip of each arm of the anchor is sized to pass through a first region of one of the keyhole-shaped voids in the firearm accessory rail while being unable to pass through a second region of the keyhole-shaped void.

7. The connector of claim 1, wherein the firearm accessory is selected from the group consisting of a vertical grip, a handstop, a bipod, a flashlight, and a laser sight.

8. A method for coupling a firearm accessory to a firearm with a connector, the method comprising:

inserting a nut into a slot disposed in an anchor of the connector, the anchor including a plurality of arms;

positioning the anchor within a body of the firearm accessory to be coupled to the firearm;

bringing the arms of the anchor into contact with a firearm accessory rail coupled to the firearm;

inserting a coupling member of the connector through a bottom end of the firearm accessory into the nut disposed in the anchor; and tightening the coupling member to the nut until the anchor is pulled into tension with both the firearm accessory and the firearm accessory rail, wherein inserting the coupling member into the nut includes passing the coupling member through an intermediate wall of the firearm accessory before the coupling member reaches the anchor such that the coupling member, the intermediate wall of the firearm accessory, the anchor, and the firearm accessory rail are all brought into tension with one another when the coupling member is tightened to the nut.

9. The method of claim 8, wherein bringing the anchor into contact with the firearm accessory rail includes bringing corresponding angled surfaces of the anchor and of the firearm accessory rail into contact.

10. The method of claim 9, wherein bringing the corresponding angled surfaces into contact includes inserting the anchor into one or more voids disposed in the firearm accessory rail.

11. The method of claim 9, wherein bringing the corresponding surfaces into contact includes inserting the anchor into one or more voids disposed in the firearm accessory rail and sliding the anchor along one or more of the voids.

12. The method of claim 8, wherein the anchor is Y-shaped and formed as a unitary component.

13. The method of claim 8, wherein the firearm accessory rail is a Picatinny rail.

14. The method of claim 8, wherein the firearm accessory rail includes a plurality of keyhole-shaped voids.

15. The method of claim 8, wherein the nut and the slot in the anchor are each square.

16. A connector for coupling a firearm accessory to a firearm, the connector comprising:

an anchor configured to couple a firearm accessory to a firearm accessory rail of a firearm, the anchor including a plurality of arms and a slot, wherein each of the arms includes a surface that forms a lip with respect to a distal end of the arm;

a nut housed within the slot; and a coupling member configured to couple the anchor to the firearm accessory rail when inserted into the nut through a bottom end of the firearm accessory and tightened until the anchor is pulled into tension with both the firearm accessory and the firearm accessory rail, wherein the lip of each arm includes an angled surface that corresponds to an angled surface of the firearm accessory rail.

17. The connector system of claim 16, wherein a distance between the arms corresponds to a width of a Picatinny rail.

* * * * *